US005413250A

United States Patent [19]

Gueret

[11] Patent Number: 5,413,250

[45] Date of Patent: May 9, 1995

[54] UNIT FOR DISPENSING AT LEAST ONE FLUID PRODUCT, IN PARTICULAR A COSMETIC OR PHARMACEUTICAL PRODUCT

[75] Inventor: Jean-Louis Gueret, Paris, France

[73] Assignee: L'Oreal, Paris, France

[21] Appl. No.: 174,062

[22] Filed: Dec. 28, 1993

Related U.S. Application Data

[62] Division of Ser. No. 916,256, Jul. 21, 1992, Pat. No. 5,301,850, which is a division of Ser. No. 556,546, Jul. 24, 1990, Pat. No. 5,154,328.

[30] Foreign Application Priority Data

Jul. 25, 1989 [FR] France ..... 89 10000
Feb. 1, 1990 [FR] France ..... 90 400269.8

[51] Int. Cl.[6] ..... B65D 35/56

[52] U.S. Cl. ..... 222/105; 222/107; 222/494; 222/571

[58] Field of Search ..... 222/92, 105, 107, 321, 222/380, 383, 385, 491, 494, 571

[56] References Cited

U.S. PATENT DOCUMENTS

| | | | |
|---|---|---|---|
| 1,881,488 | 10/1932 | Gleason | 222/494 |
| 2,753,091 | 7/1956 | Herzig | 222/491 |
| 2,755,974 | 9/1952 | Godfrey | 222/494 |
| 2,814,419 | 11/1975 | Lipman | 222/207 |
| 3,062,416 | 11/1962 | Cooprider | 222/321 |
| 3,288,334 | 11/1966 | Corsette | 222/107 |
| 3,420,413 | 1/1969 | Corsette | 222/107 |
| 3,820,689 | 4/1973 | Cocita | 222/207 |
| 3,991,916 | 11/1976 | Del Ron | 222/402.13 |
| 4,084,731 | 1/1976 | Ayes | 222/380 |
| 4,099,651 | 5/1975 | von Winckelmann | 222/94 |
| 4,124,150 | 8/1975 | Moss | 222/494 |
| 4,548,338 | 10/1985 | Sander | 222/92 X |
| 4,671,428 | 6/1987 | Sputz | 222/107 |
| 4,830,284 | 5/1989 | Maerte | 222/321 X |

FOREIGN PATENT DOCUMENTS

| | | | |
|---|---|---|---|
| 388502 | 5/1932 | Belgium . | |
| 530788 | 6/1929 | Germany | 222/491 |
| 2328549 | 6/1973 | Germany | 222/491 |
| 2083142 | 5/1980 | United Kingdom . | |

*Primary Examiner*—Andres Kashnikow
*Assistant Examiner*—Joseph A. Kaufman
*Attorney, Agent, or Firm*—Cushman, Darby & Cushman

[57] ABSTRACT

The invention concerns a unit for dispensing at least one fluid product; this unit comprises at least one dispensing duct, each comprising at its end portion a closing system opening towards the outside. The closing system is formed by an obturator which forms part of a component made of an elastically deformable material and a seat which forms part of another component of the dispensing head. The obturator is in contact with its associated seat in the absence of any dispensing action, moving away from the seat by elastic deformation under the pressure of the product to be dispensed, and returning by elasticity into contact with the seat when the dispensing stops. The obturator is subjected to the action of a constraining element tending to keep it applied to the seat wherewith it cooperates.

7 Claims, 11 Drawing Sheets

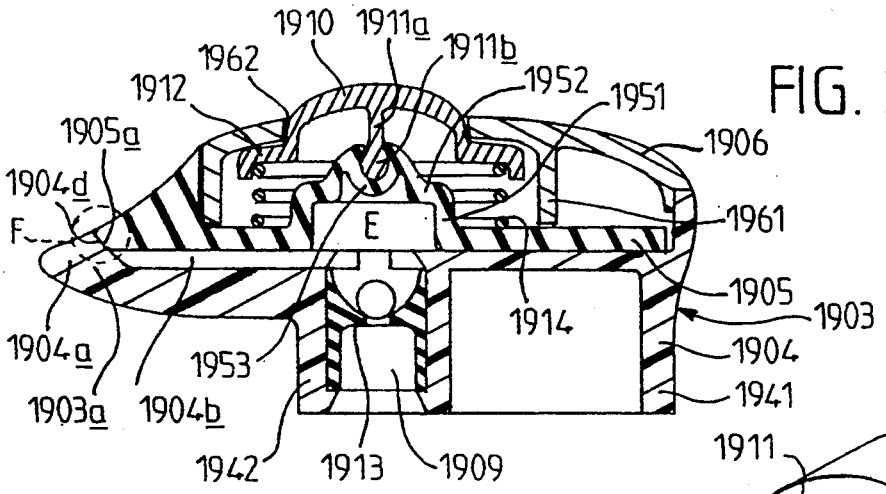
FIG. 23a
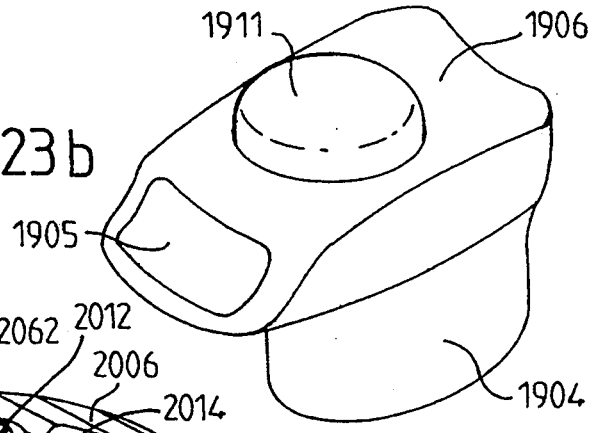
FIG. 23b
FIG. 24
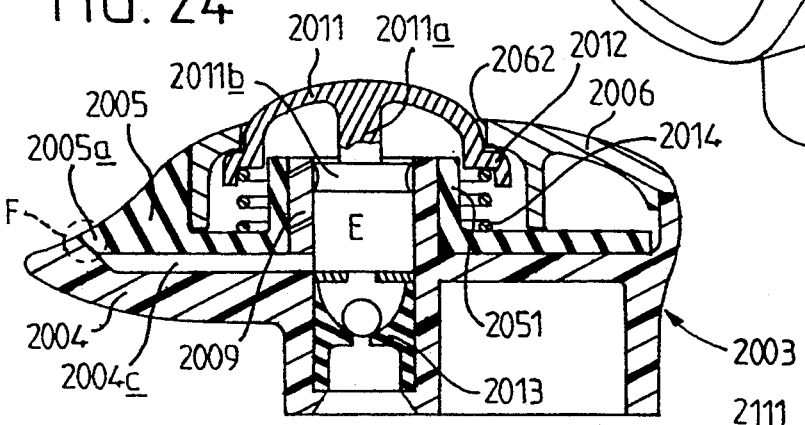
FIG. 25a
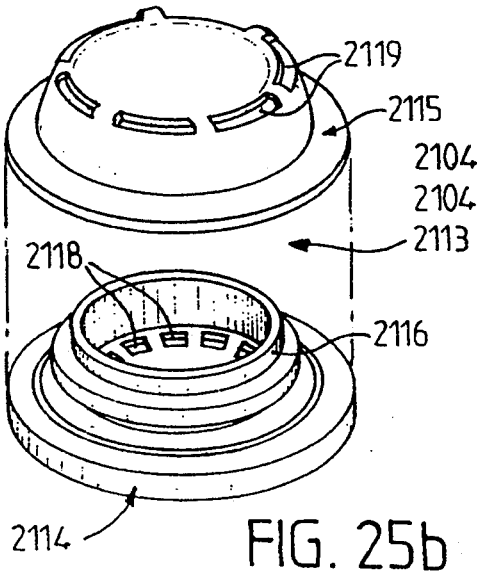
FIG. 25b
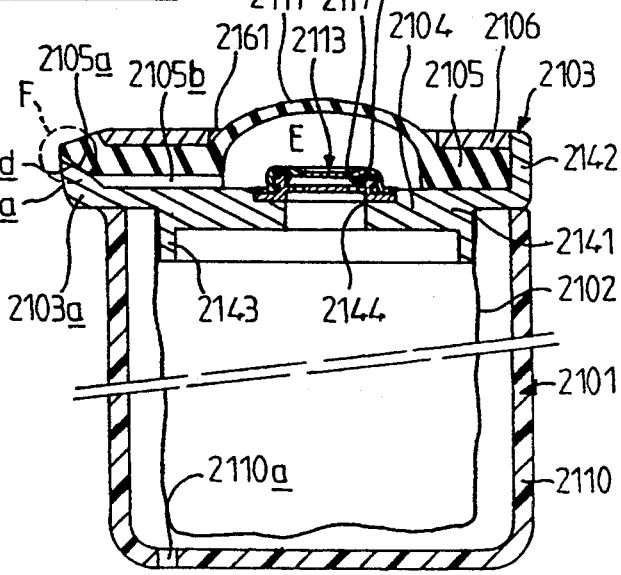

UNIT FOR DISPENSING AT LEAST ONE FLUID PRODUCT, IN PARTICULAR A COSMETIC OR PHARMACEUTICAL PRODUCT

This is a division of application Ser. No. 07/916,256, filed Jul. 21, 1992, now U.S. Pat. No. 5,301,850, which is a division of 07/556,546, filed Jul. 24, 1990, now U.S. Pat. No. 5,154,328.

FIELD OF THE INVENTION

The present invention concerns a unit for dispensing one or several fluid product(s) in a liquid form or a more or less thick cream (or pasty) form. This unit permits in particular the dispensing of cosmetic or pharmaceutical products.

PRIOR ART

Many dispensing units are known comprising a container containing the product to be dispensed and having a dispensing head fixed thereon in a detachable or non-detachable manner. This dispensing head comprises a device allowing the user to actuate the dispensing, and at least one dispensing duct communicating on the one hand with the container containing the product to be dispensed and on the other hand, with the outside.

When there are several products to be dispensed, the container may in the known manner comprise several parts, that is to say it is either constituted by several independent containers or it is constituted by a single container subdivided by internal partitions into several compartments, with each of the containers or compartments connected to a duct of the same dispensing head. The dispensing head may also contain a compartment for a product different from the one in the container, this compartment being connected to the dispensing duct for the product in the container or to a different duct.

It is known that after the dispensing of the product, a part of it remains in the dispensing duct. This part of the product is in contact with the air during the renewed air intake by the dispensing head and possibly during storage. This product may therefore be degraded by oxidation or contaminated by impurities and microorganisms in the air and, as a result, during a subsequent dispensing the dispensed product may have lost its qualities and even have become noxious.

In U.S. Pat. No. 4,099,651, it has been proposed to resolve this problem by a closure system that only opens under the pressure of the product to be dispensed. This U.S. Patent describes a dispensing head comprising a tubular element fixed on the end fitting of a flexible tube. The tubular element contains, over at least a part of its length, a flat partition projecting from the tubular element. Two outlet ducts are thus defined for the product. A sleeve made of an elastic material is fitted on to the tubular element and on to the portion of the partition projecting therefrom. The closure system is constituted by the edge of the sleeve made of the elastic material which rests on the two faces on the side remote from the end of the flat partition. This edge is in contact with these two faces of the partition when no dispensing action takes place, and moves away from these faces during dispensing of the product and returns into contact with these faces by elasticity when the dispensing stops.

However, in such a closure system, the contact between the edge of the sleeve and the face of the partition is ensured by only the elasticity of the edge zone of the sleeve and frequently this results in a very inadequate seal during the state of rest, irrespective of the contact surface between the edge of the sleeve and each of the faces of the partition, in particular when the dispensed product is viscous.

OBJECTS OF THE INVENTION

It is an object of the present invention to provide a closure system for such dispensing units, which is perfectly leakproof during the state of rest, that is to say, when the product is not being dispensed, which only opens under the pressure of the product to be dispensed, and which on its own virtually does not allow any air to be readmitted. This system is therefore aseptic per se which is not the case as far as said U.S. Pat. No. 4,099,651 is concerned.

SUMMARY OF THE INVENTION

The present invention therefore provides a unit for dispensing at least one fluid product, which unit comprises: a container and a dispensing head containing at least one dispensing duct for the product(s) to be dispensed, a closure system situated at the end portion of said at least one duct and opening towards the outside of the or each dispensing duct, the closure system being formed by at least one obturator which forms part of a component of the dispensing head made of an elastically deformable material and by at least one seat which forms part of another component of the dispensing head, the obturator(s) being in contact with their associated seat when no dispensing action takes place, moving away from the seat by elastic deformation under the pressure of the product to be dispensed, and returning into contact with the seat by elasticity when the dispensing stops; characterized in that the or each said obturator is subjected to the action of a constraining element tending to keep it applied to the seat wherewith it cooperates to ensure the seal of the closing contact.

It shall be understood that the seal mentioned in the definition given below is only ensured subject to production tolerances. According to the invention, the seal must be sufficient to prevent practically any air intake through the closure system on completion of dispensing of the product, irrespective of the viscosity of the product to be dispensed. Since the seal is to some extent a function of the contact zone between the obturator and the seat, the invention makes provision for choosing a contact zone having an adequate dimension to ensure the seal.

According to the present invention, the closure system therefore forms a valve or discharge valve which can only open in one direction: i.e. in the dispensing direction of the product.

The closure system according to the invention, which in practice is only constituted by a small contact zone between an obturator of flexible material and a seat, has the advantage of being capable of being fitted on all the dispensing heads, whether these are mounted on welded tubes, or on dispensers with a follower piston or with a flexible bag, or on rigid bottles. It may also be easily incorporated in dispensing heads with very different aesthetic shapes. In fact, the flexible component comprising the obturator and the component carrying the seat of the obturator may have various forms.

The obturator may be constituted either by a lip moving away from the seat by bending perpendicularly to the direction of the pressure of the product, or by an elastic element having one part thereof disposed facing the outlet opening of the dispensing duct and which, in this zone, moves away from the seat by elasticity in a direction parallel to the direction of the pressure of the product.

The obturator may be of any elastically deformable material. It is, preferably, made of a natural, synthetic or thermoplastic elastomer. The elastomers which may be used include, for example, styrene-butadiene copolymers, nitrile rubbers, polychloroprene or neoprene, EDPM rubber, polyurethanes, silicone rubber and ethylene-vinylacetate copolymers. When the obturator is a lip, the obturator may be constituted by an aluminium foil fixed to a sheet of plastic material (e.g. polyethylene or polyethylene terephthalate (PET)), or sandwiched between two plastic sheets.

The seat is preferably of a rigid material, but may also, in particular when the obturator has the shape of a lip, be of resilient material.

The constraining device has the function of keeping the obturator applied to the seat during storage and of increasing the pressure necessary for obtaining deformation of the obturator, thus improving the seal of the closure system. It may also have the function of facilitating return of the obturator into its closing position. It is advantageously adjustable so as to make it possible to adjust the pressure of the product that is necessary for opening the closure system. In the absence of a constraining element, it is frequently difficult to maintain the leakproof quality of the seam during storage before and after the first use of the product to be dispensed.

When the obturator is constituted by a lip forming part of a resilient component made of a flexible material, in particular a strip, the constraining element may be formed by a rigid element bearing on the component made of a flexible material or be fixed thereto so as to keep the lip applied to the seat. This rigid element may be a cover or a support maintaining the component made of the flexible material in the vicinity of the lip, a partition perpendicular to the direction of flow bearing on a wall parallel thereto, of the resilient component; this wall may be obtained, for example by means of an extra thickness of the component made of a flexible material. It is also possible for the constraining element to be not rigid but of resilient material: it may, for example, be formed by a resilient bead or stud limiting the displacement of the flexible lip.

When the obturator is a resilient part moving away from the seat in the direction of the pressure of the product, the constraining element is more particularly formed by a stud or bead of a resilient material maintaining the flexible part on the rigid element comprising the seat so as to oppose the deformation of the obturator.

The end portion of the dispensing duct is preferably delimited on the one hand by a part made partly of a flexible material, comprising the obturator, and on the other hand by a part comprising the seat of the obturator. The duct may be arranged in the part comprising the obturator and/or in the part comprising the seat. In this case, the passing of the product from the duct to the closure system is effected via a slope so as to facilitate the flow of the product while avoiding a threshold effect. This slope is advantageously situated in the seat. The duct can also be delimited by a zone where the part comprising the obturator and the part comprising the seat are fitted together in a leakproof manner, for example by bonding or by means of a weld bead.

In a first embodiment, the obturator is formed by a lip moving away from the seat by bending perpendicular to the direction of pressure of the product to be dispensed. In the closure system, the contact zone between the flexible lip and the seat may be curved or wave-shaped; it is preferably constituted by a flat portion which can for example be rectangular or may have the shape of a tongue rounded at its end. The lip may project slightly from the seat so as to form a spatula for the direct application of the product dispensed on to a surface, in particular the skin in the case of a cosmetic product. The seat may also project from the lip, the outlet for the product being effected inside a surface appertaining to the part comprising the seat and/or to a cover or support. The flat portion of the contact zone may be perpendicular to the longitudinal axis of the unit, slant in relation to this axis or be parallel thereto along the direction of the end portion of the duct. The part comprising the lip preferably has the general shape of a strip made of a resilient material reducing in thickness to form the lip; the reduction in thickness preferably takes the form of a bevel. The strip may comprise a core formed by an aluminium foil so as to render it more impermeable; this core may be placed on or beneath the strip or be embedded in the resilient material forming the strip. The strip may, or may not extend over the whole transverse cross section of the dispensing head.

In a first variant, the part comprising the seat and the seat on which the lip bears, are made of a rigid material. In this case, the constraining element is advantageously formed by a cover or a support made of a rigid material, the strip made of the resilient material comprising the lip which is thus contained between two rigid parts: the part comprising the seat and the support or cover. Reference will be made to a support for a part situated on the side of the container in relation to the strip, and to a cover for a part situated on the opposite side to the container in relation to the strip made of a resilient material. It is, of course, understood that the cover or the support leaves the lip forming part of the strip free so that it can move away from the seat. The cover or support preferably has a shape facilitating the application of the lip to the seat and the return of the lip into its rest position in a leakproof contact with the seat, that is to say the cover or support has a shape promoting the resilient memory of the lip. For this purpose, the cover or the support may comprise at least one rib or at least one stud fitting into a respective said rib or into at least one corresponding hole of the strip. The cover may also comprise a sliding flap system so as to regulate the constraint exerted on the lip.

In a particular embodiment of this variant, the dispensing head comprises a lateral outlet; the at least one duct of the dispensing head is formed by a first conduit parallel to the longitudinal axis of the dispensing unit communicating with the container, and by a second conduit forming an angle with the first conduit, the part comprising the seat made of a rigid material and the strip made of a resilient material delimiting the second conduit over the whole of its length and constituting at the end of the second conduit a closure system formed by the lip situated at the outer end of the strip and by an end surface of the part comprising the seat. The closure system and a portion of the second conduit are preferably disposed in a lateral extension forming a beak for example a radial beak of the dispensing head.

In a second variant, the seat and the part comprising the seat are made of a resilient material. The part comprising the seat may then be formed by a second strip made of a resilient material substantially parallel to the first strip, advantageously identical with the first strip, the strip and the seat made of a resilient material being externally held between the rigid walls constituting the constraining elements. A semi-rigid wall may be provided between the strip and the seat made of a resilient material, the lip and the seat projecting beyond the end of the semi-rigid wall, and the lip and the seat being capable of coming to bear on each other when the system is at rest. The strip and the part comprising the seat preferably surround the semi-rigid wall and are, in this case, advantageously moulded from a single piece.

In a second embodiment of the invention, the obturator is formed by a resilient part, one part whereof is disposed opposite the outlet opening of the dispensing duot and which in this zone, moves away from a rigid seat by elasticity parallel to the direction of pressure of the product. The resilient part advantageously forms part of a torus externally round the dispensing head. The torus may completely surround the dispensing head or may be interrupted and comprise at each end an anchorage in the part comprising the seat. To allow the flow of the product to be directed to the outlet of the dispensing duct, the part made of a resilient material comprises a feeder duct for the product. One may also arrange, in the rigid seat opposite the part made of a resilient material, a duct having the same function. The cross-section of the resilient torus may have various forms such as: circular, elliptical, triangular or similar. The constraining element is advantageously formed by a stud capable of being inserted in a corresponding recess of the part comprising a rigid seat, this stud being disposed on the side remote from the feeder duct for the product.

The closure system in accordance with the invention may be used in many types of dispensing heads.

In a first type, the dispensing head does not allow any readmission of air i.e. it does not have any air inlet. In this case, a vacuum is gradually formed in the container. The container used then preferably comprises a follower piston which moves towards the opening of the container as the dispensing is carried out, or comprises a flexible bag or tube, the walls of the bag or tube coming closer to each other as the dispensing proceeds. In this case the closure system in accordance with the invention, which closes immediately after the product to be dispensed has passed, may make it possible to dispense with the mounting of a second valve, whereas the dispensing heads generally used on containers with follower pistons or bags usually comprise two valves.

The dispersing head may also comprise a second valve associated with the closure system in accordance with the invention, the latter forming the first valve. In this case, the push button may carry a piston displaced in an internal space forming a pump barrel. The push button may advantageously comprise a flexible membrane, accessible from the outside which performs the function of a piston by modifying the volume of the internal space. The volume of the pump barrel formed may be disposed parallel to the longitudinal axis of the unit or perpendicular to the latter, the push button being actuated parallel or perpendicular to the longitudinal axis.

Provision may be made for a part of the wall of the dispensing head to be made of a thin resilient material, so that it can be pierced by means of a hypodermic needle; the needle serves either to create a vacuum, and therefore to eliminate the air and to draw up the product contained in the container into the dispensing head without contaminating the dispensing opening, or to create an excess pressure which allows the dispensing head to be cleaned out by means of a sterile gas, for example nitrogen. The thin part may constitute a portion of the strip provided with a lip of the closure system.

A second type of dispensing head, the latter comprises an air inlet or readmission valve. This air readmission valve is preferably constituted by a valve made of a resilient material. This valve is preferably cup-shaped and advantageously slit on the side wall near its top. This valve is more particularly arranged in the strip of resilient material forming the obturator.

The dispensing head may comprise a device allowing the closure system to be locked and protected during storage and which is removed for effecting the first dispensing. This locking device may be a device removed for the first dispensing and which is not replaced subsequently. However, it is advantageous for the locking device to be replaced after one or several dispensing actions to ensure the seal during transport and to prevent an accidental opening of the closure system. This device is most frequently formed by a cover fixed by screwing or catch engagement, and which covers practically the whole of the dispensing head. It is also possible for the locking device to act only on the closure system proper. In this latter case, the locking device may be constituted by a sliding flap or a small tearable plate which for example blocks the flexibility of the lip of the resilient strip of the closure system. It may also be constituted by a stud which blocks the resilience of the obturator in the closure system by catch engagement in the vicinity of the dispensing opening; this stud is advantageously disposed on a stirrup which is capable of swivelling round the two axes of the dispensing head. The stirrup may also serve as a lever for exerting the dispensing pressure after the catch engagement of the stud has been released.

Many other dispensing units in accordance with the invention may be envisaged by the expert, without thereby departing from the scope of the invention.

BRIEF DESCRIPTION OF THE DRAWINGS

In order that the present invention may more readily understood, several embodiments thereof will now be described below on a purely illustrative and non-restrictive basis, with reference to the attached drawings.

In these drawings:

FIGS. 23*a* and 23*b* show an axial cross-section and a view in perspective, respectively, of a dispensing head with two valves with a particular device for actuating the pump;

FIG. 24 represents an axial cross-section of a dispensing head comprising another particular device for actuating the pump;

FIG. 25*a* represents a dispensing unit comprising two valves, the pump being actuated by a flexible dome;

FIG. 25*b* represents the detail of the lower valve on an enlarged scale;

DETAILED DESCRIPTION OF THE PREFERRED EMBODIMENT

Figure 1:
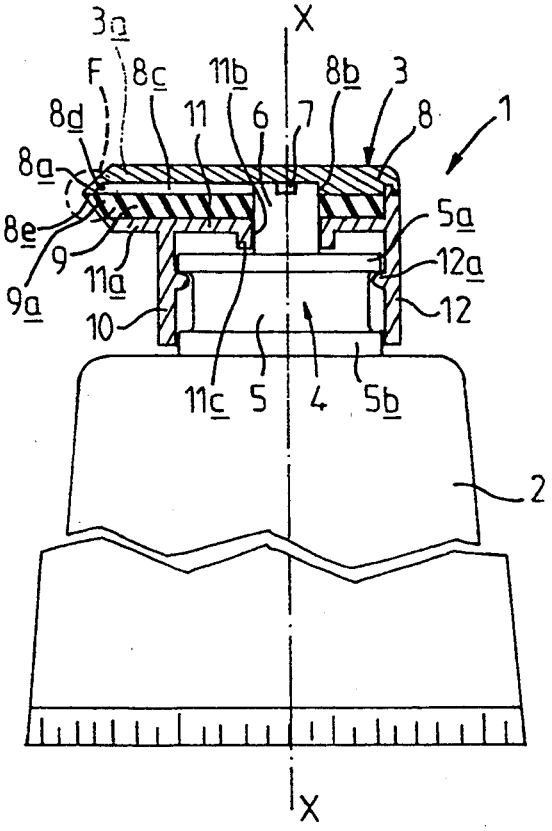
FIG. 1 is a longitudinal sectional view of a dispensing unit in accordance with the invention, not provided with a second valve, in the storage position.
Figure 2:
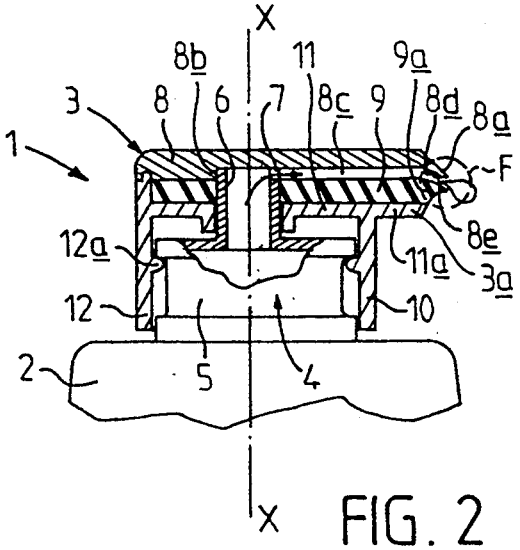
FIG. 2 is a view of the same dispensing unit in the dispensing position.

In the embodiment represented in FIGS. 1 and 2, the unit 1 is formed by a dispensing head 3 which comprises a single valve constituted by a closing system with a resilient lip in accordance with the invention, the head being mounted on a flexible tube 2.

The tube 2 is provided with a neck 4 comprising on the side of the tube, a part 5 with a larger diameter and on the side of the dispensing head, a coaxial part 6 with a smaller diameter. The part 5 is provided with two circular beads 5*a* and 5*b* having the same outer diameters.

The part 6 with the smaller diameter has at least one rectangular cut out 7 on its upper edge.

The dispensing head 3 is a head for lateral dispensing. It has a generally cylindrical shape provided with a lateral radial extension forming a beak 3*a*; the closing system F is situated at the outer end of this beak 3*a*.

This dispensing head 3 comprises a part 8 comprising the seat situated in a plane perpendicular to the longitudinal axis X—X of the unit 1, covering the whole external surface of the dispensing head which is furthest away from the tube 2, that is to say, the upper surface in FIG. 1. This part 8 comprising the seat has the shape of a disc provided with a radial beak 8*a*, rectangular in shape and projecting outwardly. The part 8 comprising the seat is also provided with a cylindrical hole 8*b* wherein the narrow part 6 of the neck 4 of the tube 2 becomes inserted. A groove 8*c* terminates near the outer edge of the beak 8*a* of the part 8 comprising the seat with a slope 8*d* inclined towards the outside and towards the tube 2, the inner face (the upper face in FIG. 1) of the outer edge of the beak forms the seat 8*e*. The seat 8*e* is situated in a plane perpendicular to the longitudinal axis X—X of the dispensing unit and has the shape of a rectangle.

A strip 9 made of a resilient material comprising the lip of the closing system is placed into contact with the inner face (the lower face in FIG. 1) of the part 8 comprising the seat 8*e* and rests on a support 10. The strip 9 made of a resilient material covers the whole of the inner surface of the part 8 comprising the seat, that is to say, it has the shape of a disc provided with a beak whose end is bevelled and which is situated opposite the beak 8*a* of the part 8 comprising the seat. The bevelled end of the beak is inclined towards the part 8 comprising the seat and its edge forms the lip 9*a* of the closing system.

To sum up, the closing system F in accordance with the invention is constituted by the seat formed by the surface 8*e* of the beak 8*a* and by the lip 9*a* of the strip 9, which lip is formed by the outer bevelled edge of the beak.

The support 10 performs the function of the constraining element. It comprises a flat, rigid wall parallel to the part 8 comprising the seat and to the strip 9 having the shape of a disc 11 provided with a rectangular beak 11*a* disposed opposite the beak 8*a* of the part comprising the seat 8 and the beak 9*a* of the strip 9. The bevel of the beak of the strip 9 forming the lip 9*a* projects beyond the beak 11*a* of the rigid wall. In the flat side 11, there is arranged an axial and circular opening 11*b* surrounded by a cylindrical skirt 11*c* turned towards the tube 2. The skirt 11*c* surrounds the narrowest part 6 of the neck 4 of the tube 2.

The support 10 also comprises a peripheral skirt 12 fixed at the periphery of the part 8 comprising the seat 8e by a rib and groove system, except for the region of the edge of the beak 8a of the part comprising the seat 8e. This skirt 12 comprises a cut out opposite the beak 11a of the rigid disc 11.

The skirt 12 is provided on its inner side with a circular bead 12a which comes to be positioned by catch engagement under the bead 5a of the largest diameter part 5 of the neck 4 of the tube 2.

The apparatus functions as follows: when the user wishes to dispense the product contained in the tube 2, he turns the dispensing head 3 until the cut out 7 of the neck 4 comes to be opposite the groove 8c of the seat 8. Then he squeezes on the tube 2, which causes the product to pass through the first duct formed by the neck 4 into the second perpendicular duct delimited by the strip 9 and the groove 8c of the part 8 comprising the seat.

When the product arrives in the vicinity of the closing system F, the lip 9a formed by the edge moves away, because the surface 8e of the beak 8a is bent away from the surface 8 comprising the seat, perpendicular to the direction of pressure of the product, and the product can emerge as illustrated in FIG. 2. The support 10 holding the strip limits the displacement of the lip 9a during the opening of the closing system. When the user stops pressing on the tube 2, there is no longer any pressure of the product to be dispensed in the region of the closing system F and the lip 9a returns by elasticity into contact with the seat 8e, in the closing zone F. The support 10 then exerts a certain constraint on the strip 9, which applies the lip 9a against the seat 8e and ensures the suitable desired seal. Air can no longer penetrate into the tube 2, and therefore the product can no longer be contaminated by impurities or microorganisms, nor be oxidized.

Figure 3:
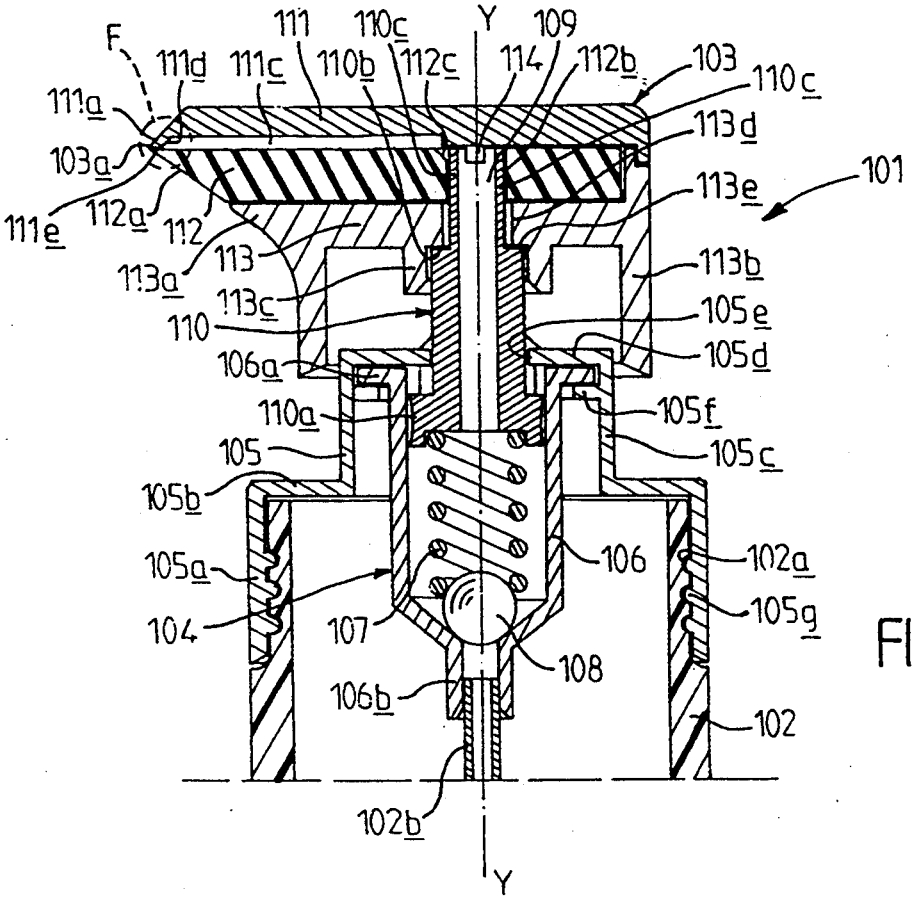
FIG. 3 is a longitudinal section view of another dispensing unit in accordance with the invention, wherein the dispensing head is mounted on a pump bottle.

Like FIGS. 1 and 2, FIG. 3 represents a dispensing unit wherein the closing system F comprises a lip carried by a strip made of a resilient material, but the dispensing head is mounted on a pump bottle. The dispensing unit is designated by 101 as a whole. It comprises a rigid bottle 102 on which is fixed a pump system 104 and a dispensing head 103. The dispensing head 103 comprises an outer radial projection forming a beak 103a, the closing system F being disposed at its end.

In the embodiment represented in FIG. 3, the bottle 102 contains a dip tube 102b and is provided on the edge of its side wall nearer the opening with a male screw thread 102a.

The pump 104 is mounted on the bottle 102 at the opening.

The pump 104 comprises an outer cover cap 105 constituted by a first cylindrical skirt 105a carrying a female screw thread 105g corresponding to the male screw thread 102a of the bottle, an annular shoulder 105b, situated in a plane perpendicular to the longitudinal axis Y—Y of the dispensing unit which rests on the edge of the opening of the bottle 102, a second cylindrical skirt 105c parallel to the first skirt 105a, but with a smaller diameter and a second annular shoulder 105d parallel to the first shoulder 105c wherein there is arranged a circular opening 105e centred on the axis Y—Y. The skirt 105c carries a discontinuous inner annular flange 105f. The pump system 104 also comprises an element 106 of a cylindrical-conical shape whose conical part is tapered towards the bottle 102. This element 106 is provided on the outer edge of its cylindrical portion with an annular flange 106a resting on the discontinuous annular flange 105f of the outer cover cap 105. The edge of the conical portion of the element 106 is connected to a cylindrical duct 106b in which the dip tube 102b is fitted. The cylindrical-conical element 106 contains a compression spring 107 and a ball 108 with a diameter larger than that of the duct 106b and smaller than that of the cylindrical portion of the element 106. A hollow piston 110 providing an inner axial duct 109 can slide in the cylindrical portion of the element 106. It comprises, firstly, an enlarged portion 110a, having an outer diameter equal, save for the necessary clearance, to the inner diameter of the cylindrical portion of the element 106, on which portion 110a the spring 107 bears, secondly a portion 110b with an outer diameter equal to the diameter of the opening 105e of the cover cap 105 save for the necessary clearance, and thirdly a smaller diameter portion 110c that is fitted in the dispensing head 103. A rectangular cut out 114 is arranged on the edge of this portion 110c.

The dispensing head 103 is constituted by a part 111 comprising the seat 111e, a strip 112 comprising the lip 112a of the closing system F and a support 113. The part 111 comprising the seat is a disc made of a rigid plastic material provided with a beak 111a. This disc 111 bears on the portion 111c of the hollow piston 110. A radial groove 111c extending from the edge of the portion 110c of the hollow piston 110 as far as the beak 111a is arranged in the part 111 comprising the seat 111e. The groove 111c terminates in a slope 111d inclined outwardly and towards the bottle 102. The edge of the beak 111a also slopes outwardly and towards the bottle 102 and terminates in a flat rectangular surface 111e constituting the seat. A strip 112 made of a resilient material is disposed on a rigid support 113 beneath the inner face of the part 111 comprising the seat. The strip 112 also has the shape of a disc provided with a radial beak. It comprises a circular opening 112b to receive the portion 110c of the hollow piston 110. A bevel 112c cut on the edge of this opening 112b opens into the radial groove 111c of the seat 111. The end of the beak of the strip 112 is bevelled so as to form a lip 111a that is in contact with the seat 111e. The seat 111e and the lip 112a of the strip 112 in contact therewith form the closing system F in accordance with the invention.

The rigid support 113 on which the strip 112 is resting, performs the function of a constraining element. It is constituted by a disc-shaped element, provided with a radial beak 113a having a flat surface on the side of the strip and carrying an external skirt 113b extending on either side of the element 113 except in the region of the edge of the beak 113a where it only extends towards the bottle 102. This skirt 113b is fitted on the edge of the part 111 comprising the seat 111e by means of a rib and groove system except in the end region of the beak 111a. The edge of the part of the skirt 113b turned towards the bottle 102 is situated in a plane perpendicular to the longitudinal axis Y—Y of the dispensing unit and it is circular; its inner diameter is greater than that of the part 105c of the outer cover cap 105 so as to be capable of sliding thereover. The skirt 113b is cylindrical as a whole, except at the level of the beak 103a of the dispensing head 103, where it has a curved shape allowing it to conform to the shape of the beak 103a. The support 113 also carries an inner cylindrical skirt 113c having an inner diameter equal, save for the necessary clearance, to the outer diameter of the portion 110b of the hollow piston 110. A circular opening 113d having a diameter equal, save for the necessary clearance, to the outer diameter of the portion 110*c* of the hollow piston, is arranged in the support 113. The support 113 bears with an annular shoulder 113*e* situated between the opening 113*d* and the skirt 113*c* on the shoulder situated between the portions 110*b* and 110*c* of the hollow piston. It will be seen that the head 103 is movable in rotation round the hollow piston 110.

The unit illustrated in FIG. 3 functions as follows. When the user wishes to dispense the product contained in the bottle 102, he causes the head 103 to swivel round the portion 110*c* of the hollow piston 110 until the cut out 114 is opposite the bevel 112*c* arranged at the edge of the opening 112*b* of the strip 112, which allows the duct 109 to communicate with radial groove 111*c* of the seat 111. The user then presses on the outer surface (the top one in FIG. 3) of the part 111 comprising the seat. The part 103 is lowered, the piston compresses the spring 107 and the skirt 113*b* slides on the portion 105*c* of the outer cover cap 105 and the ball 108 closes the duct 106*b*. The product contained in the element 106 and in the internal duct 109 of the piston 110 is pushed towards the closing system F. The lip 112*a* of the beak of the strip 112 moves away from the seat 111*e* and the product is dispensed. When the user stops pressing, the dispensing head 103 rises again under the action of the spring 107, and under the effect of the vacuum that has been formed, the ball 108 rises, releasing the duct 106*b* and a fresh quantity of the product penetrates into the cylindrical-conical element 106. This fresh quantity will be dispensed when the user exerts renewed pressure on the part comprising the seat 111*e*. It will be seen that the closing system F replaces the second ball generally used in the pump systems to prevent the intake of air.

Figure 4:
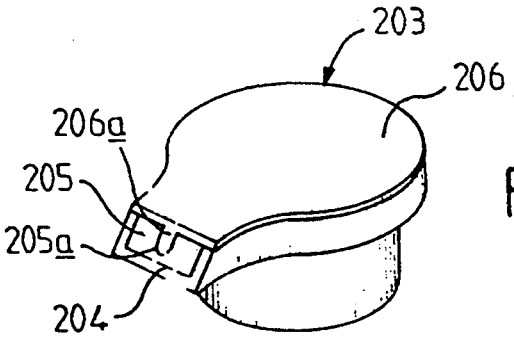
FIGS. 4 and 5 are schematic views of a dispensing head wherein the cover forming the constraining element has different shapes.

FIG. 4 represents a dispensing head generally designated 203 comprising a part 204 including the seat of the closing system, a strip 205 made of a resilient material comprising the lip of the closing system, and a cover 206 performing the function of the constraining element. The strip 205 is provided with a groove 205*a* wherein a rib 206*a* of the cover is fitted. Thus the strip 205 is stiffened, which allows the lip formed by its bevelled end to come more readily into contact with the seat located opposite it.

Figure 5:
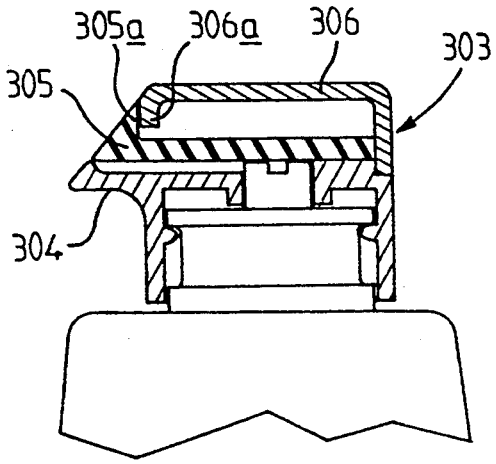

FIG. 5 represents another dispensing head generally designated 303 wherein the cover has a shape allowing the lip to be applied to the seat, and to facilitate the return of the lip of the closing system in accordance with the invention into its rest position in leakprof contact with the seat. The strip 305 rests on a part 304 comprising the seat. The strip 305 contains an end portion substantially in the shape of a right angled triangle when viewed in longitudinal section, whereof one side 305*a* is perpendicular to the general plane of the strip. The dispensing head 303 comprises a cover 306 parallel to the strip 305, that is provided with a turn 306*a* perpendicular to the general plane of the cover 306, and therefore to the strip 305 and which bears on the side 305*a* of the strip 305, thus applying the lip carried by the strip 305 to the seat-forming portion of the part 304 disposed opposite it. Moreover, the strip 305 is thus partly stiffened, which allows the lip to return more readily into contact with the seat.

Figure 6:
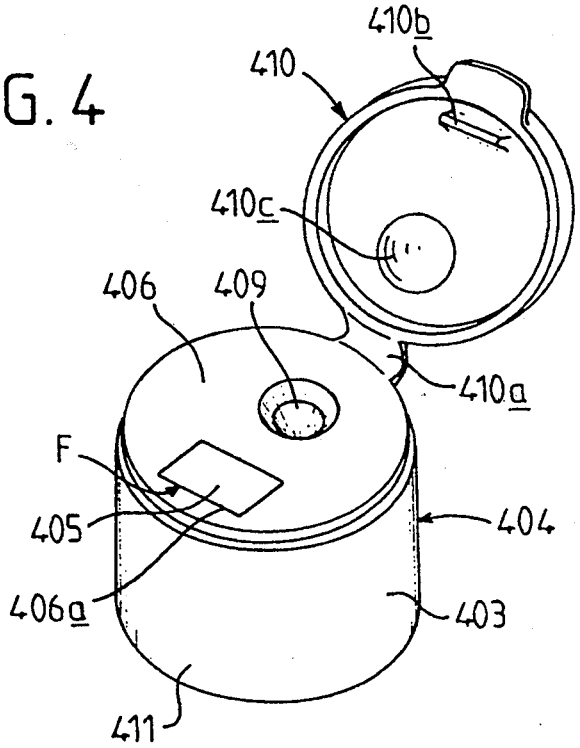
FIGS. 6 and 7 are an isometric projection and longitudinal section, respectively, representing a dispensing head comprising an air intake valve.
Figure 7:
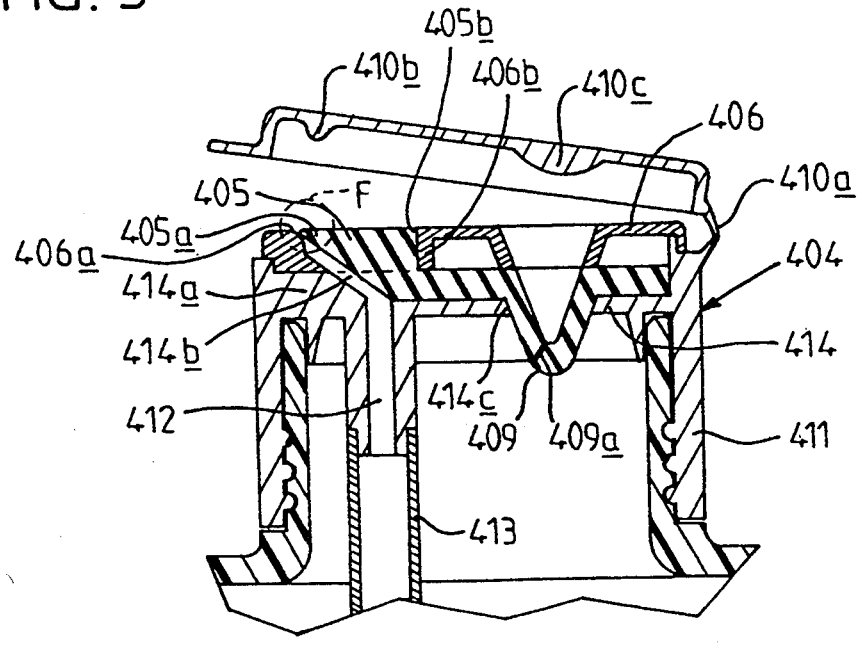

FIGS. 6 and 7 represent a dispensing head generally designated 403, comprising an air intake. The dispensing head comprises a support 404, a strip 405 carrying: the lip 405*a* of the closing system F and the air intake valve 409, a part 406 comprising the seat 406*a* also serving as an element holding the strip 405 in place, and a cover cap 410 intended to lock the closing device F and the air intake valve 409.

The support 404 comprises a cylindrical skirt 411, which in the embodiment represented in FIG. 7 is fixed by screwing onto the neck of a bottle (not represented). Perpendicular to the skirt 411 is fixed a generally flat disc 414 carrying a thickened portion 414*a* situated directly below the closing device F, and having a cross-section in the shape of a right angled trapezium whose slanting side is turned towards the bottle and towards the inside of the dispensing head 403. A duct 412 integral with the disc 414 opens at the level of the slanting side and communicates with a dip tube 413. The disc 414 is also provided with a circular opening 414*c*. The strip 405 made of a resilient material comprises a lip 405*a* formed by its bevelled end that rests on the seat 406*a* constituted by the edge of the part 406.

A channel 414*b* delimited by the part 406 forming the seat and the thickened portion 414*c* on the one hand, and the bevel of the strip 405 on the other hand, causes the duct 412 to communicate with the closing system F constituted by the lip 405*a* of the strip 405 and the seat 406*a* of the part 406. It may be noted that in the embodiment of FIGS. 6 and 7, the closing system F is not situated in a lateral beak but on the top of the dispensing head 403, the dispensing channel slanting in relation to the longitudinal axis of the unit. After the part comprising the bevel-shaped end the thickness of the strip 405 decreases, forming a shoulder 405*b*, and it carries in this thinner part a cup-shaped valve 409 whose top is turned towards the bottle and which is slit on its lateral wall 409*a*. The strip 405 is covered by the part 406 comprising the seat which is secured by being fitted on the support 404 and comprises a turn 406*b* bearing against the shoulder 405*b*. The part 406 comprising the seat 406*a* is provided with two openings, one for the closing device F in accordance with the invention and another for the valve 409. The dispensing head 403 is protected by a cover cap 410 fitted on the support 404 and fixed to the latter by a film hinge 410*a*. The face of the cover cap nearer the dispensing head is provided with two bosses, the one 410*b* ensuring the protection and the locking of the closing system F and the other 410*c* locking the air intake valve 409.

The device functions as follows: the user raises the cover cap 410 and then he actuates the dispensing head 403 by squeezing the flexible bottle. The product passes through the dip tube 413, then into the duct 412 and into the channel 414*b*. The lip 405*a* of the strip 405 moves away from the seat 406*a* and the product is dispensed. The wall 406*b* of the part 406 comprising the seat bearing on the wall 405*b* of the strip, tends to apply the lip 405*a* to the seat 406*a* and facilitates the return of the lip 405*a* into its rest position. When the user stops the dispensing, the edge of the lip 405*a* of the strip 405 returns to come to bear in a leakproof manner on the edge 406*a*, under the effect of the vacuum formed after a dose of the product has been dispensed, the lips of the slit 409*a* of the valve 409 diverge and air enters into the bottle. To finish, the user closes down the cover cap 410.

Figure 8:
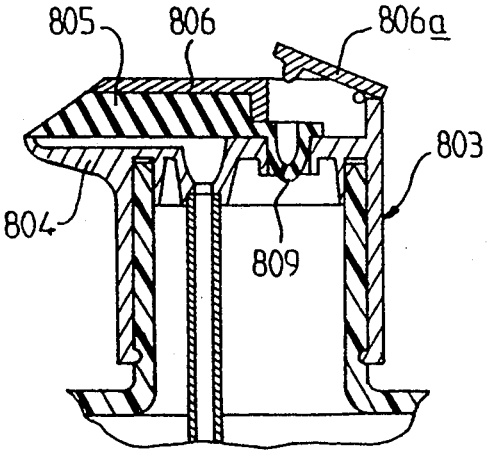
FIG. 8 represents another dispensing head with an air intake.

FIG. 8 illustrates a dispensing head with a lateral beak generally designated 803, comprising a cup-shaped valve 809 arranged in the strip 805, this strip 805 resting on a part 804 comprising the seat and being covered by a cover 806. This dispensing head 806 is not protected by a cover cap but the cover 806 is partly movable in rotation round a film hinge so as to allow the access to the air intake valve 809 to be opened or closed. The cover 806 serves at the same time as a constraining element and as an element for locking the air intake valve.

Figure 9:
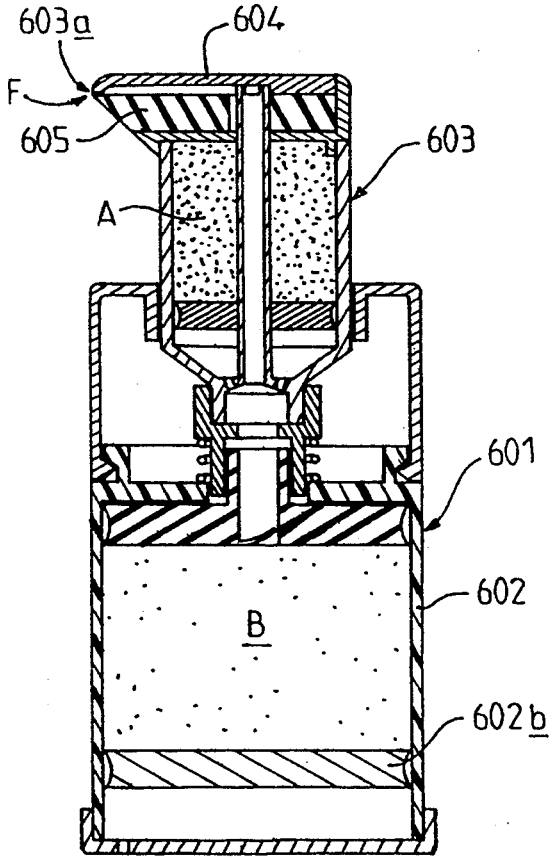
FIG. 9 schematically represents a unit for dispensing two products with a single outlet duct.

FIG. 9 schematically represents a unit 601 for dispensing a mixture of a pasty product B stored in a bottle 602 with a follower piston 602*b* and of a tracing product A that is also pasty contained in a dispensing head 603 comprising a lateral beak 603*a* wherein the closing system F is disposed (the lip of the strip 605 and a flat surface forming the seat of the part 604).

Figure 10:
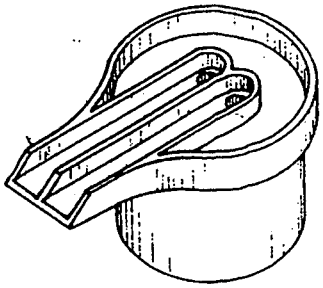
FIG. 10 represents a rigid part comprising the seat for the simultaneous dispensing of two products.

FIG. 10 represents the part forming the seat of a dispensing head for the simultaneous diffusion of two products, wherein two parallel channels are arranged.

Figure 11:
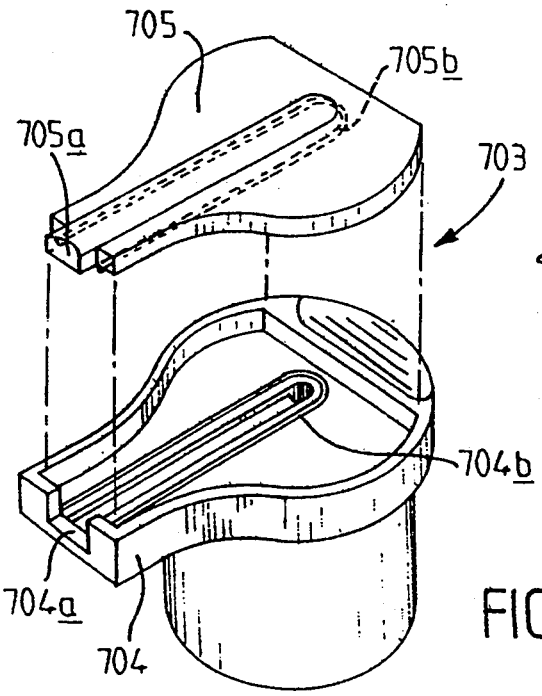
FIG. 11 illustrates a variant of the embodiment of the part comprising the seat and of the part made of a resilient material comprising the lip.

FIG. 11 represents the strip 705 of resilient material and the part 704 comprising the seat in a dispensing head 703 comprising a lateral beak. The edge 704*a* of the dispensing opening serves as seat for a lip 705*a* of the strip 705. The strip 705 comprises ribs 705*b* which are fitted in corresponding grooves 704*b* of the seat 704 and serve, on the one hand, to seal the unit and on the other hand, to stiffen the strip and to apply the lip 705*a* against the seat 704*a*.

Figure 12:
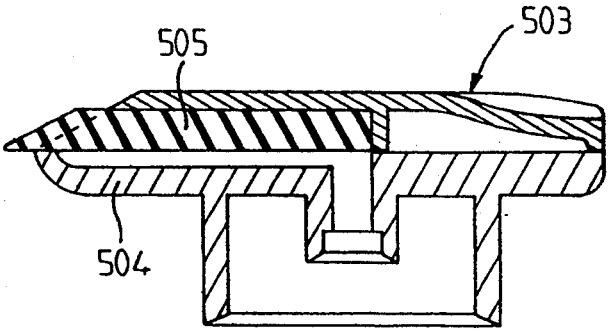
FIG. 12 illustrates a variant of the dispensing lip forming a spatula.

FIG. 12 represents a dispensing head 503 wherein the strip 505 made of a resilient material projects from the seat of the part 504 comprising the seat in such a way as to perform the function of an application spatula.

Figure 13:
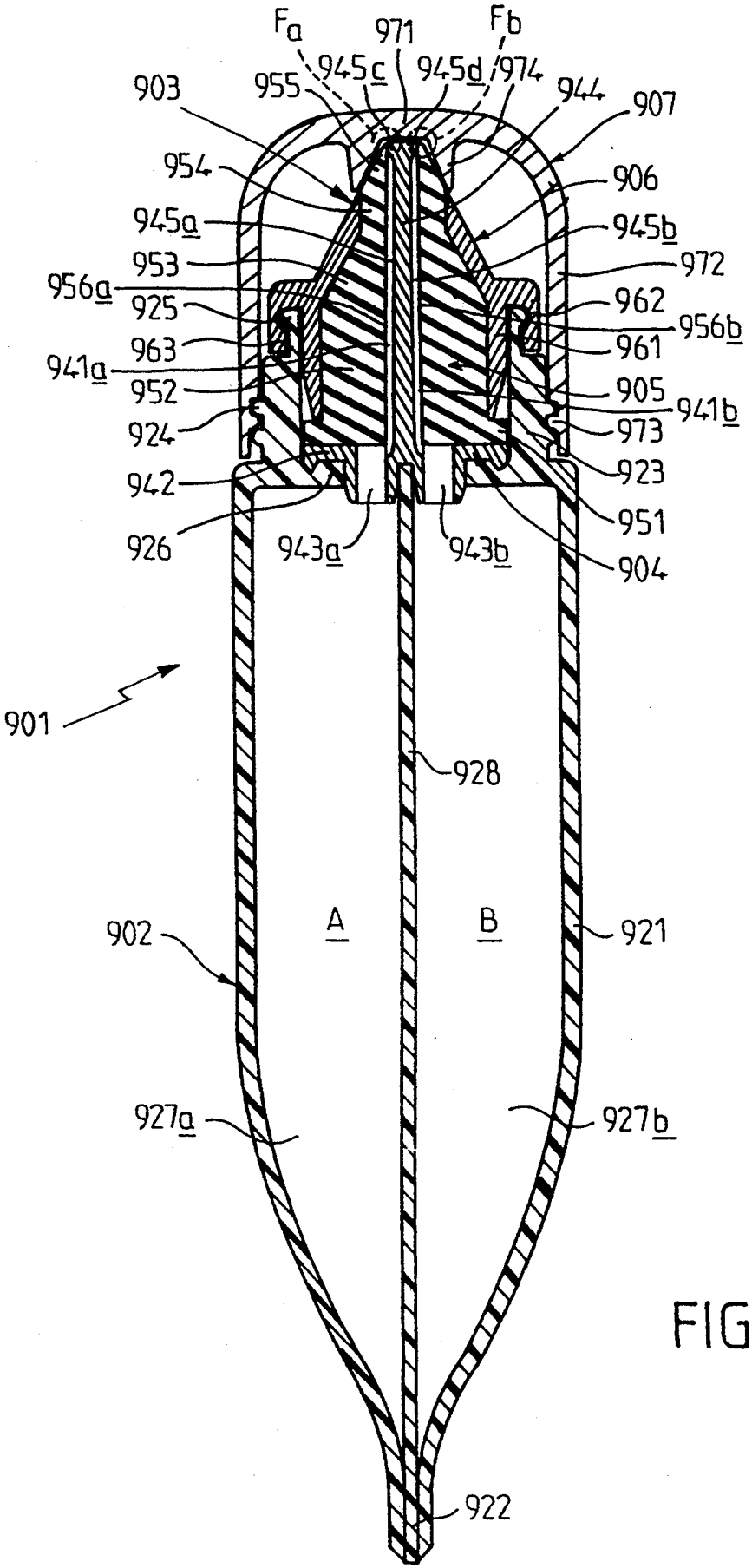
FIG. 13 represents a unit in accordance with the invention for the simultaneous dispensing of two products.

FIG. 13 represents a dispensing unit generally designated 901, comprising a tube 902 closed by a dispensing head 903 surmounted by cover cap 907 and constituted by a part 904 comprising two symmetrical seats 945*c*, 945*d*, an elastic glove finger 905 which carries two resilient lips 955 in combination with the surfaces 956*a*, 956*b* cooperating with the two seats so as to form two closing systems Fa and Fb and a cap 906 forming a constraining element.

The tube 902 is constituted by a shell 921 closed at one end by a weld 922. The end remote from the weld is provided with a neck 923 carrying a male screw thread 924 and on a smaller outer diameter portion, an annular catch engagement system 925 formed by a groove and a bead. In the region of the transition between the tube 902 and its neck 923, the neck carries an internal annular flange 926. The tube is subdivided into two compartments 927*a* and 927*b* by a flat partition 928 situated in the plane of symmetry of the tube. The compartment 927*a* contains a product A and the compartment 927*b* a product B.

The dispensing head 903 comprises two ducts 941*a* and 941*b* for dispensing the product; each of the ducts 941*a* and 941*b* is closed respectively by a closing system Fa and Fb in accordance with the invention.

The part 904 comprising the seat is constituted by a disc-shaped part 942 which is fitted by means of a rib-groove system on the flange 926 near the transition between this flange and the inner wall of the neck 923. The disc 942 is provided with two ducts 943*a* and 943*b* disposed symmetrically in relation to the partition 928 and extending towards the compartment 927*a* and the compartment 927*b*, respectively. The disc 942 carries a parallelepiped finger 944 with a rectangular cross section centred on the axis of symmetry of the dispensing head 903 in the extension of the partition 928. The finger 944 carries on its faces disposed symmetrically in relation to the partition 928, two grooves 945*a* and 945*b* forming together with the glove finger 905, the outlet ducts 941*a* and 941*b* for each one of the products A and B. These outlet ducts terminate before the end of the finger 944 providing flat surfaces 945*c* and 945*d* which respectively form parts of the closing devices Fa and Fb in the ducts 941*a* and 941*b*.

The finger 944 preferably comprises on the faces on the opposite side to those carrying the grooves, two longitudinal grooves (not shown) intended to cooperate with corresponding grooves (not shown) of the glove finger 905 to facilitate its mounting. The glove finger 905 is fitted on the finger 944 of the part 904 comprising the seat. It includes an annular flange 951 resting on the flange 942 of the seat and has an outer diameter equal to the inner diameter of the neck 923 of the tube 902. The flange 951 is extended in a smaller diameter cylindrical portion 952 connected to a still smaller diameter cylindrical portion 954, by a frustoconical portion 953. The glove finger 905 terminates in a bevelled end fitting 955 forming the lips. Within the glove finger 905 is an internal duct assuming the shape of the finger 944. This duct comprises two flat surfaces 956*a* and 956*b* bearing on the faces of the finger 944 provided with grooves 945*a* and 945*b*. The end of each of these flat surfaces corresponding to the end of the bevelled end fitting 955 forming the lips, cooperates with the flat surfaces 945*c* and 945*d* of the seat to form the respective closing devices Fa and Fb in accordance with the invention.

The cap 906 is formed by a cylindrical-conical skirt 961 whose inner side bears on the outer side of the portions 952, 953 and 954 of the glove finger 905. The conical portion of the outer side of the skirt 961 lies in the extension of the bevelled end fitting 955 forming the lips. The cap 906 comprises a second outer skirt 962 provided on its inside with a bead 963 cooperating by catch engagement with the bead 925 of the neck 923 of the tube.

The dispensing head 903 is covered, as shown in FIG. 13, by a cover cap 907 which comprises a top 971 and a cylindrical skirt 972. The edge of the skirt 972 carries on its inside a thread 973 cooperating with the male thread 924 of the neck 923 of the tube 902 for fixing the compartment 907 on the neck 923 of the tube 902 by screwing. The top 971 of the cover cap carries an internal skirt 974 whose inner side assumes the shape of the outer side of the bevelled end fitting 955 forming the lip of the glove finger 905. This skirt protects the closing system Fa and Fb during storage and prevents the lips 955 from being accidentally moved away from each other.

This device functions as follows. When the user wishes to dispense the two products contained in the tube, he presses on either side of the tube perpendicularly to the partition 920. The product A, for example, passes under the action of this pressure into the duct 943*a* and then into the channel 941*a*. In the vicinity of the flat surface 945*c* it moves aside the lip formed by the bevelled end 955 of the elastic glove finger 905, by bending it. The closing device Fa is opened and the product is dispensed. When the user stops pressing on the tube, the lip returns by elasticity on to its seat formed by the flat surface 945*d*. The closing device Fa is closed in a leakproof manner and air can no longer penetrate into the compartment 927*a*. The procedure for dispensing the product B is identical. To finish, the user secures the cover cap 907 on the tube to cover the dispensing head.

Figure 14:
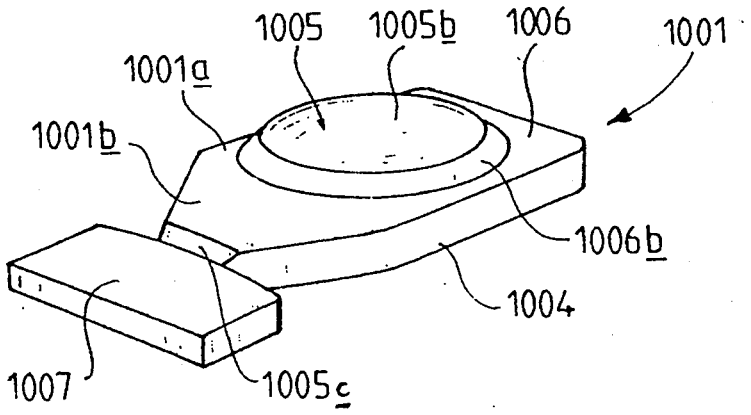
FIGS. 14 and 14*a* represent in perspective and in cross section, respectively, a dispensing unit in accordance with the invention where the dispensing is actuated by a flexible dome.
Figure 14A:
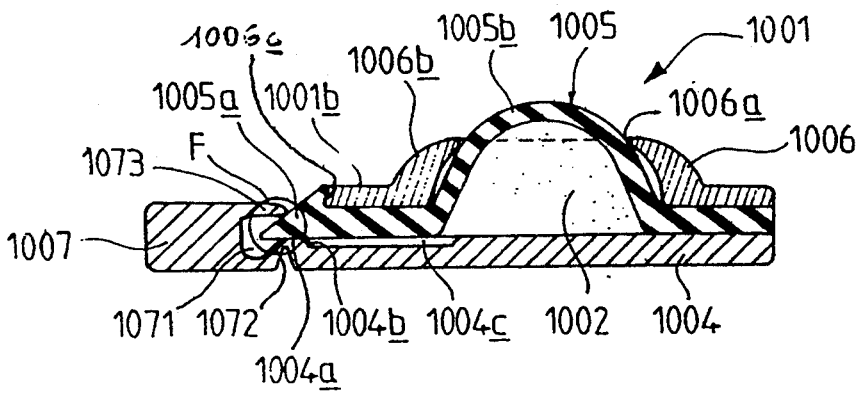

In the embodiment represented in FIGS. 14 and 14*a*, the dispensing unit is designated by 1001. The unit is more particularly intended for the dispensing of products in the form of single, or sample doses.

In this unit the dispensing head and the container are integrated. The unit is constituted by a rigid part 1004 comprising the seat 1004*a* of the closing system F, by a strip 1005 carrying the lip 1005*a* of the system F, and by a cover 1006 forming the constraining element, the strip 1005 being sandwiched between the part comprising the seat 1004 and the cover 1006. The system F is protected by a frangible small plate 1007.

The unit has the aspect of a casing comprising a rectangular portion 1001*a* constituting in essence the part forming the container and a trapezoidal portion 1001*b* constituting in essence the part forming the dispensing head.

The part 1004 comprising the seat is formed by a plate of plastic material provided in its trapezoidal portion with a channel 1004*c* ending in a slope 1004*b*, the part 1004 ending in a flat surface 1004*a* which constitutes the seat of the closing system F.

In its trapezoidal portion, the strip 1005 terminates in a bevel so as to form a lip 1005*a* which cooperates with the seat 1004*a* in the closing system F. In the illustrated embodiment the lip 1005*a* is extended beyond the seat 1004*a* to form a spatula facilitating the application of the dispensed product.

In the region of the square portion 1001*a* of the unit 1001, the strip 1005 forms a dome 1005*b* which defines a chamber 1002 forming a container for the product above the part 1004 comprising the seat 1004*a*.

The cover is provided with an opening 1006*a* surrounded by a crown 1006*b* through which the dome 1005*b* is accessible. In the trapezoidal portion, it ends in a slanted partition 1006*c* which cooperates with a corresponding slanting partition of a thickened portion 1005*c* of the strip 1005 so as to bear on the lip 1005*a* on the seat 1004*a*.

The plate 1007 for locking the closing system F is a plate made of a plastic material comprising in its thickness a cut out 1071 into which the lip 1005*a* penetrates. The lower side 1072 of this cut out is welded by a self-breaking weld to the part 1004 at the level of the seat 1004*a* and the upper side 1073, which is thin and has a degree of elasticity, comes to grip the strip 1005.

When the user wishes to dispense the product, he raises the plate 1007 by turning it to break the weld between the side 1071 and the part 1004, and then he releases the lip 1005*a*. To dispense the product, he presses on the resilient dome 1005*b*. Under the exerted pressure, the product emerges from the chamber 1002 and passes through the channel 1004*c*. The product subsequently moves the lip 1005*a* away from the seat 1004*a* and the product emerges.

When the user stops pressing on the resilient dome 1005*b*, the lip 1005*a* comes into leakproof contact with the seat 1004*a*.

FIGS. 15 to 18 represent dispensing heads comprising a closing system constituted by a resilient strip resting on a seat which is also resilient.

Figure 15:
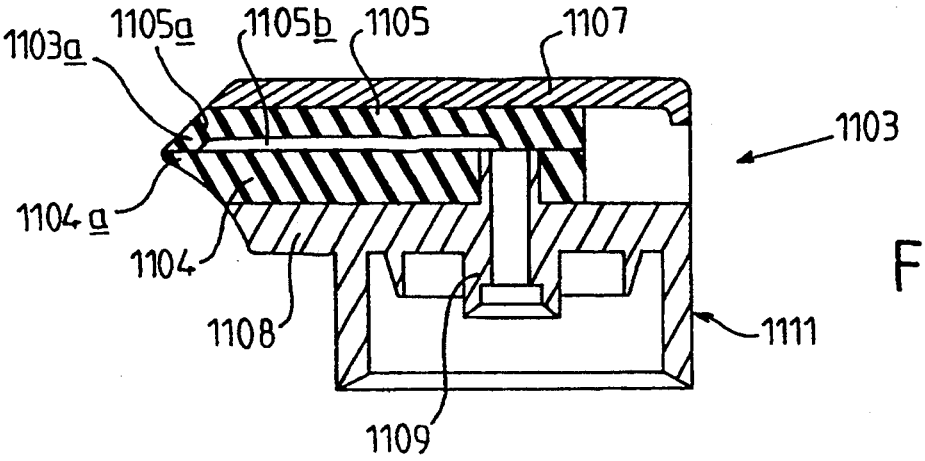
FIG. 15 is an axial section of a variant of the dispensing head wherein the part comprising the seat of the closure system is constituted by a strip of resilient material.

In the embodiment represented in FIG. 15 the resilient strip 1105, together with its lip 1105*a* comprising the seat formed by its bevelled end, rests on a part 1104 made of a material which is resilient, and is preferably similar to that of the strip 1105. The seat 1104 is strip-shaped and ends in a bevel 1104*a*, constituting the substantially symmetrical seat of the bevel 1105*a* in relation to the joint of these two strips.

The unit comprising the strip 1105 and the seat-forming part 1104 is sandwiched between a rigid cover 1107 and a rigid support 1108 forming constraining elements.

In the embodiment represented in FIG. 15, the dispensing head 1103 comprises a lateral beak 1103*a* containing the outlet channel for the product to be dispensed. The channel 1105*b* is cut in the strip 1105 and extends as far as the lip 1105*a*. A duct 1109 passes through the support 1108 in a direction orthogonal to the median plane of this support and it is connected to the channel 1105*b*. On the side remote from the seat 1104, the support 1108 comprises means 1111 allowing it to be joined to the neck of a container of the type having follower piston or a flexible bag.

Figure 16:
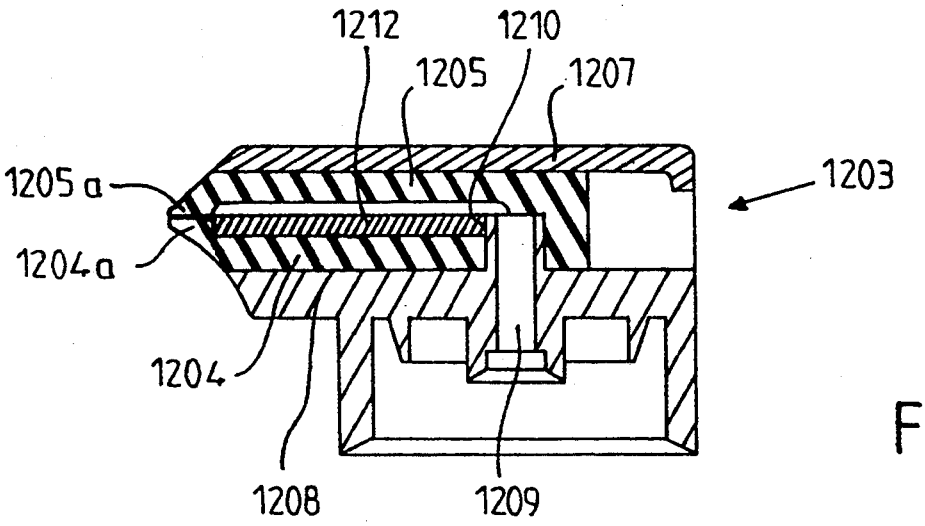
FIG. 16 is a variant of the dispensing head of FIG. 15 with an intermediate semi-rigid part between two resilient strips.

FIG. 16 shows a variant 1203 of the dispensing head at the lateral outlet of FIG. 15. The dispensing head comprises a strip 1205 provided with a lip 1205*a* and a flexible part 1204 including the seat sandwiched between a support 1208 and a cover 1207 forming constraining elements. The strip 1205 is the same as the strip 1105 of FIG. 15, but the part 1204 including the seat 1204*a* comprises a longitudinal cut out 1210 which extends as far as a lip 1204*a* identical with the lip 1105*a* of the strip 1105, the seat 1204*a* being symmetrical with the lip 1205*a* in relation to the plane of the joint.

In the embodiment represented in FIG. 16, a rigid or semi-rigid wall forming a partial stiffener, is disposed in the cut out 1210. This wall 1212 extends substantially from the outer contour of the duct 1209 passing through the support 1208 as far as the lip 1204*a*.

Figure 17:
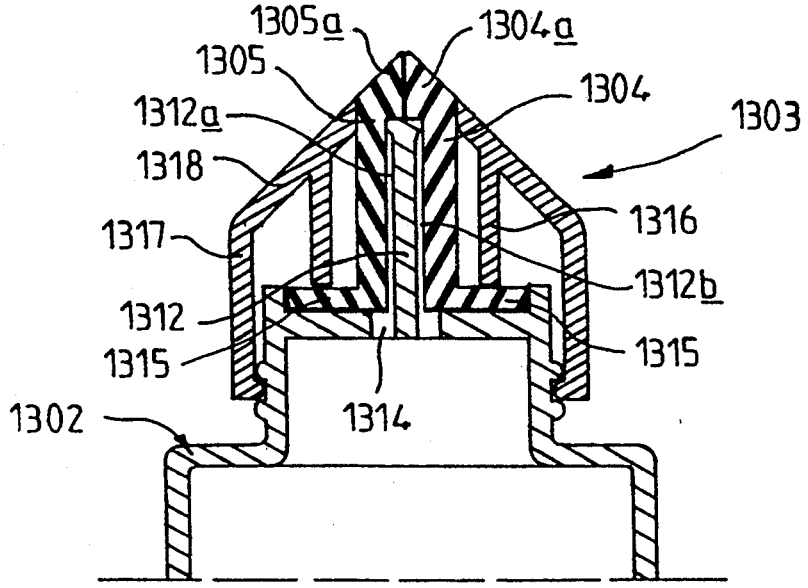
FIG. 17 is an axial section of a head similar to that of FIG. 16, but with an axial and non-lateral outlet for the product to be dispensed.

FIG. 17 represents a dispensing head 1303 comprising, like the one represented in FIG. 16, a strip 1305 and a resilient support 1304 comprising the seat 1304*a* separated by a stiffener 1312 but arranged to form an outlet for the product along the axial direction of the container 1302. The strip 1305 and the resilient support 1304 are provided at their ends respectively with a lip 1305*a* and a seat 1304*a* and they are symmetrical in relation to the plane of their joint, this joint plane, in the illustrated embodiment, passing through the axis of the container 1302. The wall 1312 forming the stiffener is disposed between the strip 1305 and the part 1304 forming the seat 1304*a*. It is provided with two symmetrical channels 1312*a* and 1312*b*. The product emerges from the container 1302 through an opening 1314 whose diameter is sufficient to allow the product to enter on either side of the wall 1312 into the channel 1312*a* and 1312*b* towards the lip 1305*a* and the seat 1304*a* and the outlet slot.

The strip 1305 and the part 1304 comprising the seat comprise in their lower portions a radially outwardly extending rim 1315 capable of being gripped by the lower edge of a sleeve 1316 provided in a rigid shell 1317 surrounding the strip 1305 and by the part comprising the seat 1304 and ensuring the mounting on the neck of the container 1302 by catch engagement. The rigid shell 1317 constitutes the constraining element. It comprises a roof-shaped upper end 1318 which comes to hold the strip 1305 and the seat 1304 at the base of the freely projecting lips 1305*a* and 1304*a* of this shell 1317. It should be noted that the strip 1305 and the part 1304 comprising the seat may form two separate parts or a single part.

Figure 18:
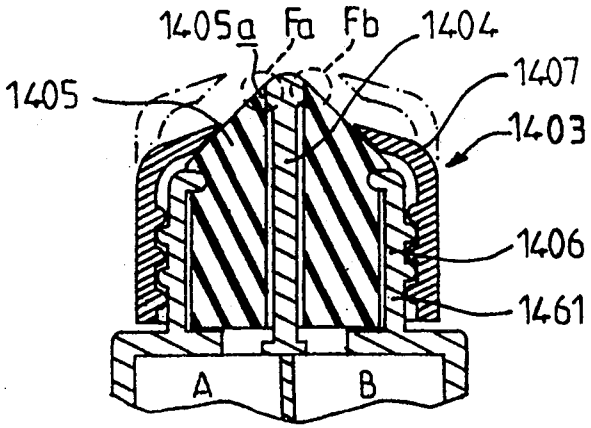
FIG. 18 is also a schematic axial section similar to that of FIG. 13 comprising a particular protective device for the resilient strips.

FIG. 18 represents a variant of the dispensing head represented in FIG. 13. The dispensing head 1403 comprises a glove finger 1405 which is fitted on a support in the shape of a parallelepiped finger 1404 with a rectangular cross-section so as to form two symmetrical closing systems Fa and Fb for the outlets of the products A and B respectively.

In the embodiment represented in FIG. 18, the cap 1406 holding the exterior of the glove finger 1405 comprises a cylindrical skirt 1461, provided in its upper portion with a bead inserted in a corresponding circular groove of the strip 1405 near the start of the bevel 1405 of the strip. This skirt carries a male screw thread carrying a constricting ring 1407. By screwing this ring, it can be displaced between a low position where it locks the strip 1405 and a high "in-use" position (represented in dots and dashes in FIG. 18) where the strip 1405 is released.

Figure 19:
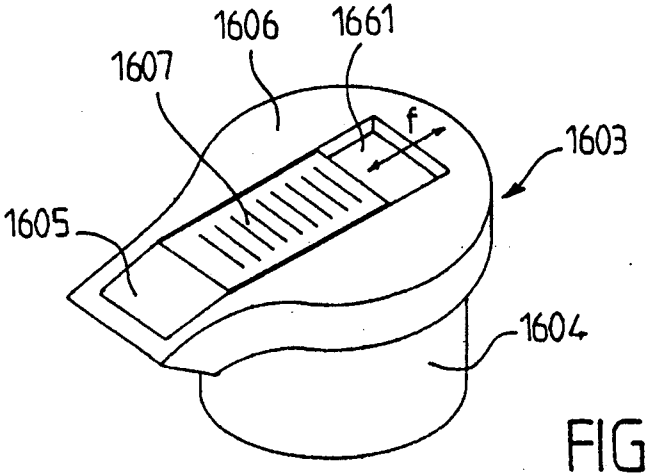
FIGS. 19 and 20 represent in perspective and in axial section, respectively, a dispensing a head similar to that of FIG. 2 comprising a particular system for locking the strip of the closure system.
Figure 20:
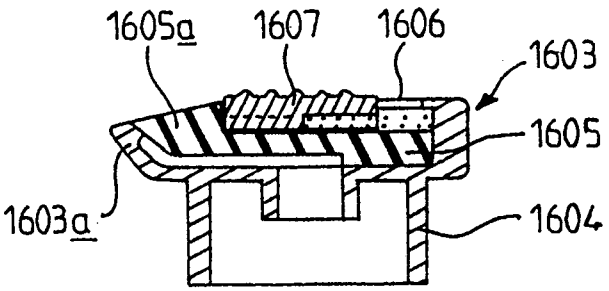

FIGS. 19 and 20 show a dispensing head 1603 with a lateral beak comprising a strip 1605 sandwiched between a rigid part 1604 including the seat and a cover 1606 forming a constraining element. A rectangular opening 1661 is arranged on the cover 1606, which opening is disposed symmetrically in relation to the median plane of the strip and extends from the limit of the bevel 1605*a* of the strip 1605 diametrically up to the vicinity of the edge of the lid on the side remote from the beak 1603*a* of the dispensing head 1603. In this opening, there may slide, along the double arrow f, a tongue 1607 which modifies according to its position the flexibility of the lip of the strip 1605 so as to regulate the pressure of the product necessary for opening the closing system.

Figure 21A:
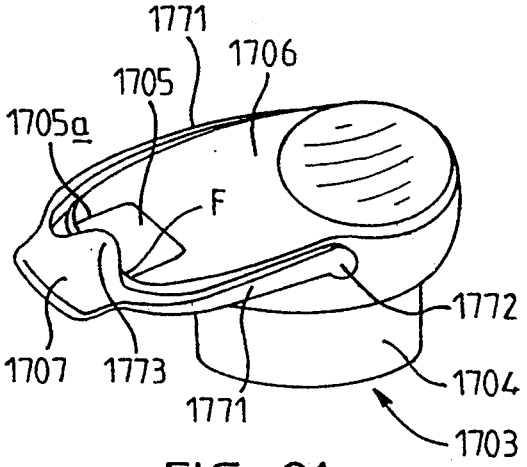
FIGS. 21*a* to 21*c* schematically represent a head similar to that of FIG. 2 comprising a locking system with a stirrup, FIG. 21*a* being a view in an isometric projection, FIG. 21*b* being a side view of the locked dispensing head and FIG. 21*c* being a side view of the dispensing head as it is being locked.
Figure 21B:
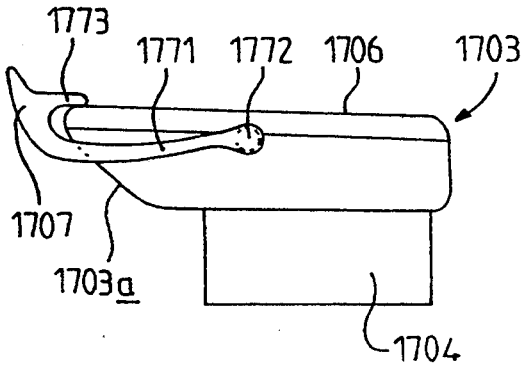
Figure 21C:
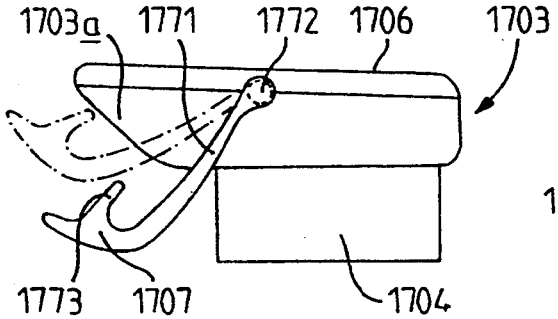

FIGS. 21*a* to 21*c* schematically represent a dispensing head 1703 with a lateral beak 1702*a* comprising a strip 1705 with a bevelled end 1705*a* resting on a part comprising the seat and held in position by a cover 1706 forming the constraining element. The lip 1705*a* of the strip may be held in position during storage by means of a locking device constituted by a stirrup 1707 made of a fixed semi-rigid material pivoting by the catch engagement of its two lateral arms 1771 on two pins 1772 and provided on the transverse bar with a stud 1773 disposed in the region of the closing system F. In the storage position, the stirrup 1707 is in the position represented in FIGS. 21*a* and 21*b*. FIG. 21*c* represents the stirrup 1707 in dots and dashes as it is being unlocked, and in the rest position in solid lines, after having been unlocked.

Figure 22A:
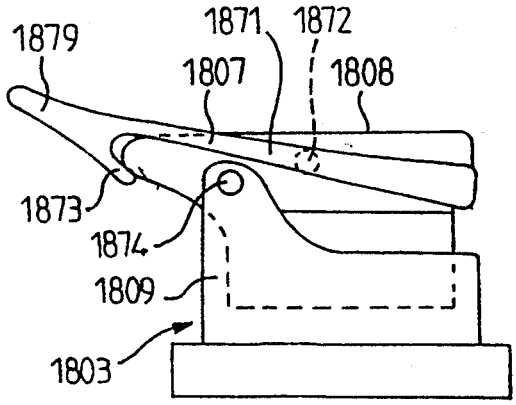
FIGS. 22*a* to 22*c* schematically represent a system similar to that of FIG. 21 where the stirrup may serve for controlling the dispensing of the product, FIGS. 22*a* and 22*b* being side views of the dispensing head in a locked position and a dispensing position, and FIG. 22*c* being a view in an isometric projection.
Figure 22B:
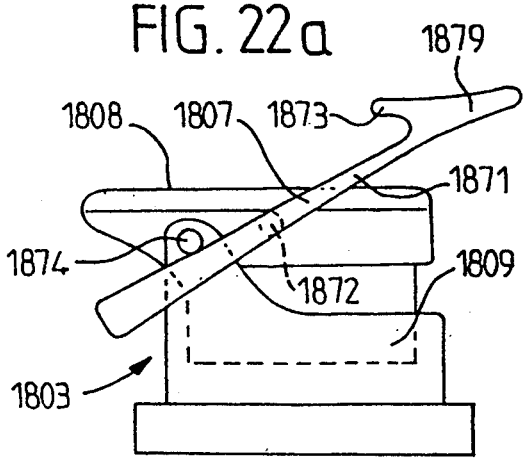
Figure 22C:
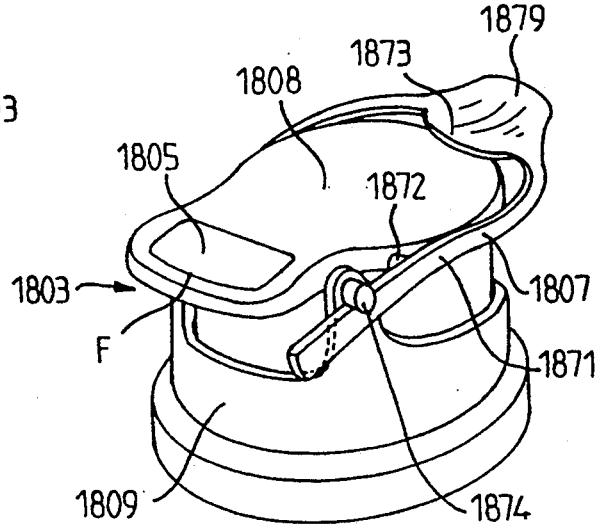

FIGS. 22*a* to 22*c* schematically represent a dispensing head 1803 with a lateral beak forming a pump comprising a push button and a stirrup 1807 for locking the strip 1805 of the closing system F. The stirrup 1807 is pivotal about a point near the centre of its arms 1871, by being fixed on two pivot pins 1872 carried by the push button 1808. The transverse bar of the stirrup is provided with an enlarged portion 1879, one edge of which carries the stud 1873 and forms a slightly curved surface forming an angle with the arms of the stirrup. The stirrup 1807 swings between a position represented in FIG. 22*a* where it locks the closing system by means of the stud 1873 and, through the intermediate position represented in FIG. 22*b*, to a position represented in FIG. 22*c* where the stirrup 1807 rests with a portion of its enlarged surface 1879 on the upper surface of the push button and is locked by a pin 1874 carried by a fixed tab integral with the container 1809. The stirrup may then be used as a lever for bearing on the push button 1808. By pressing on the curved side of the enlarged portion 1873, the user obtains a gearing down of the pressure force exerted on the push button 1808.

FIGS. 23*a* and 23*b* represent an embodiment of a dispensing head 1903 with a lateral beak 1903*a* forming a pump. The dispensing head 1903 comprises a part 1904 comprising the seat 1904*d* provided with a beak 1904*a*. In the part 1904, there is cut a radial channel 1904*b* which extends in the beak 1904*a* and terminates in the region of the bead comprising a flat surface constituting the seat 1904*d*. The part 1904 comprising the seat is provided with an outer skirt 1941 arranged so as to be capable of being mounted on the container (not shown) and an inner skirt 1942 whose side is locally identical with that of the skirt 1941 which defines a duct 1909 communicating the container with the channel 1904*b*. This duct 1909 contains a ball valve 1913 in which the ball is held on the side nearer the dispensing head. The strip 1905 made of a resilient material rests on the part 1904 forming the seat, and comprises a bevelled portion 1905*a* whose lip cooperates with the surface 1904*d* of the support to form the closing system F in accordance with the invention. After the bevelled portion 1905*a*, the strip 1905 has a reduced thickness, and opposite the duct 1909 it has a cup-shaped portion 1951 whose side wall comprises an annular step 1952 forming a bellows and whose top is hollowed out by a partly spherical cavity 1953. The strip 1905 is surmounted by a cover 1906 fixed on the support 1904, except in the region of the end of the beak 1903*a*, and which comprises an inner skirt 1961 whose bottom edge bears on the portion with a reduced thickness of the strip 1905 and against the side of the bevel 1905*a*. There is a circular opening 1962 in the cover 1906, situated opposite the cup-shaped portion 1951 of the strip, and having a diameter larger than the maximum diameter of the part 1951 at its base. A push button 1910 is placed in the opening 1962. It comprises a dome 1914 connected to a flange 1912. The flange 1912 is applied against the inner side of the cover 1906 by means of a spring 1914 which is mounted round the cup 1951 and bears on the one band against the flange 1912 and on the other hand, against the reduced thickness portion of the strip 1905. The dome 1912 carries at its centre, a stem 1911*a*, having a sphere 1911*b* fixed at its end. This sphere 1911*b* comes to be inserted into the cavity 1953 of the cup-shaped portion 1951 of the strip 1905.

The device functions as described below. When the user wishes to dispense some of the product, he depresses the dome 1911 by compressing the spring 1914. The cup-shaped portion 1951 is deformed and its internal volume E decreases. The ball valve 1913 is closed. The pressure of the product contained in the space E and the channel 1904*b* causes the closing system F to open and the product is dispensed. When the user relaxes his pressure on the dome 1911, the spring returns the flange 1912 to bear against the cover 1906; the cup-shaped portion 1951 reassumes its shape by elasticity; and the internal space E increases while producing low pressure. Simultaneously, the closing system F is closed in a leakproof manner. The low pressure in the internal space E causes the ball valve 1913 to open and the product to be drawn up from the container into the internal space E.

FIG. 24 represents a variant of the piston system represented in FIGS. 23*a* and 23*b*. The dispensing head 2003 comprises a part 2004 comprising the seat whereon there rests a strip 2005 surmounted by a cover 2006. The part 2004 comprising the seat is similar to the part comprising the seat of FIG. 23*a*. It comprises a duct 2009 causing the container, not shown, to communicate with the channel 2004*c* in the part 2004 and containing a ball valve 2013.

In the embodiment represented in FIG. 24, the duct 2009 is extended on the side of the strip 2005. This strip 2005 comprises a bevelled portion 2005*a* and a reduced thickness portion which carries a cylindrical skirt 2051 surrounding the extension of the duct 2009. The cover 2006 is provided with an opening 2062 with a diameter larger than that of the skirt 2051, in which opening there is mounted a dome 2011 having a flange 2012. A spring 2014 surrounds the skirt 2051 and bears on the one hand against the reduced thickness portion of the strip 2005 and on the other hand, against the flange 2012. At its centre, the dome 2011 carries at the end of a stem 2011*a*, a piston 2011*b* capable of sliding in a leakproof manner inside the extension of the duct 2009 which forms the pump barrel.

To actuate the dispensing head 2003 the user presses on the dome 2011, and the piston 2011*b* advances while reducing the internal space E of the extension of the duct 2009 forming the pump barrel. The rest of the functioning of the apparatus is then similar to that described with reference to FIGS. 23*a* and 23*b*.

FIG. 25*a* schematically represents a dispensing unit 2101 wherein the product to be dispensed is contained in a flexible bag 2102 protected by a rigid shell 2110 provided with an air intake opening 2110*a*. The dispensing head 2103 is of the type having a lateral outlet provided with a beak 2103*a* and forms a pump. The head 2103 comprises a part 2104 comprising the seat whereon the flexible bag 2102 is mounted and which is fixed on the edge of the rigid shell 2110. A strip 2105 is positioned on the part 2104 comprising the seat and it is held in position by a cover 2106. The part 2104 comprising the seat is constituted by a plate 2141 perpendicular to the longitudinal axis of the unit 2101 having the general shape of a disc provided with a beak. At the end of the beak, the part 2104 comprises a bead 2104*a* having a slanting flat surface 2104*d* forming the seat facing the axis of the unit and facing the container. It comprises a cylindrical skirt facing the cover 2142 which surrounds the strip except in the region of the end of the beak 2103*a*, and an upwardly facing skirt 2143 to which the flexible tube is welded. The part is pierced near its axis by a circular opening 2144 whereon is mounted a cup type of nonreturn valve which is constituted by a valve 2113 illustrated in greater detail in FIG. 25*b*. This cup valve consists of two capsules 2114 and 2115, the lower capsule 2114 being made of a relatively rigid plastic material and the capsule 2115 being relatively flexible so as to be capable of deformation. The two capsules are fixed to each other by nesting. The two capsules 2114 and 2115 are each provided with a skirt 2116 and 2117 which face each other while forming a leakproof seal, and are capable of sliding on each other until they separate, leaving a gap between them during the deformation of the capsule 2115. The capsules 2114 and 2115 have openings 2118 and 2119 respectively which can only communicate with each other when the skirts 2116 and 2117 are separated. In the beak 2103*a*, the strip 2105 comprises a bevelled portion 2105*a* which bears in a leakproof manner on the surface 2104*d* forming the seat and a dome-shaped portion 2111 with a reduced thickness, the dome having at its base a diameter larger than that of the cup valve 2113. Between the dome 2111 and the closing system F, the strip 2105 is provided with a channel 2105*b*. The cover 2106 covers the strip except in its portion corresponding to the closing system F and it is provided at its centre with a circular opening 2161 through which the dome 2111 projects outwardly.

The device of FIG. 25*a* functions in the way described below. When the user wishes to dispense the product contained in the flexible tube 2102 he presses on the resilient dome 2111, which decreases the internal space E contained under the dome 2111, the valve 2113 being closed. The product contained in the space E and in the channel 2105*b* is subjected to excess pressure and opens the closing system F. When the user stops pressing on the dome 2111 the closing system F closes again and the dome reassumes its shape by elasticity, which causes a low pressure to be formed in the internal space E. The valve 2113 opens and some product is transferred from the flexible tube 2102 into the space E.

Figures 26A, 26B, 26C, 27:
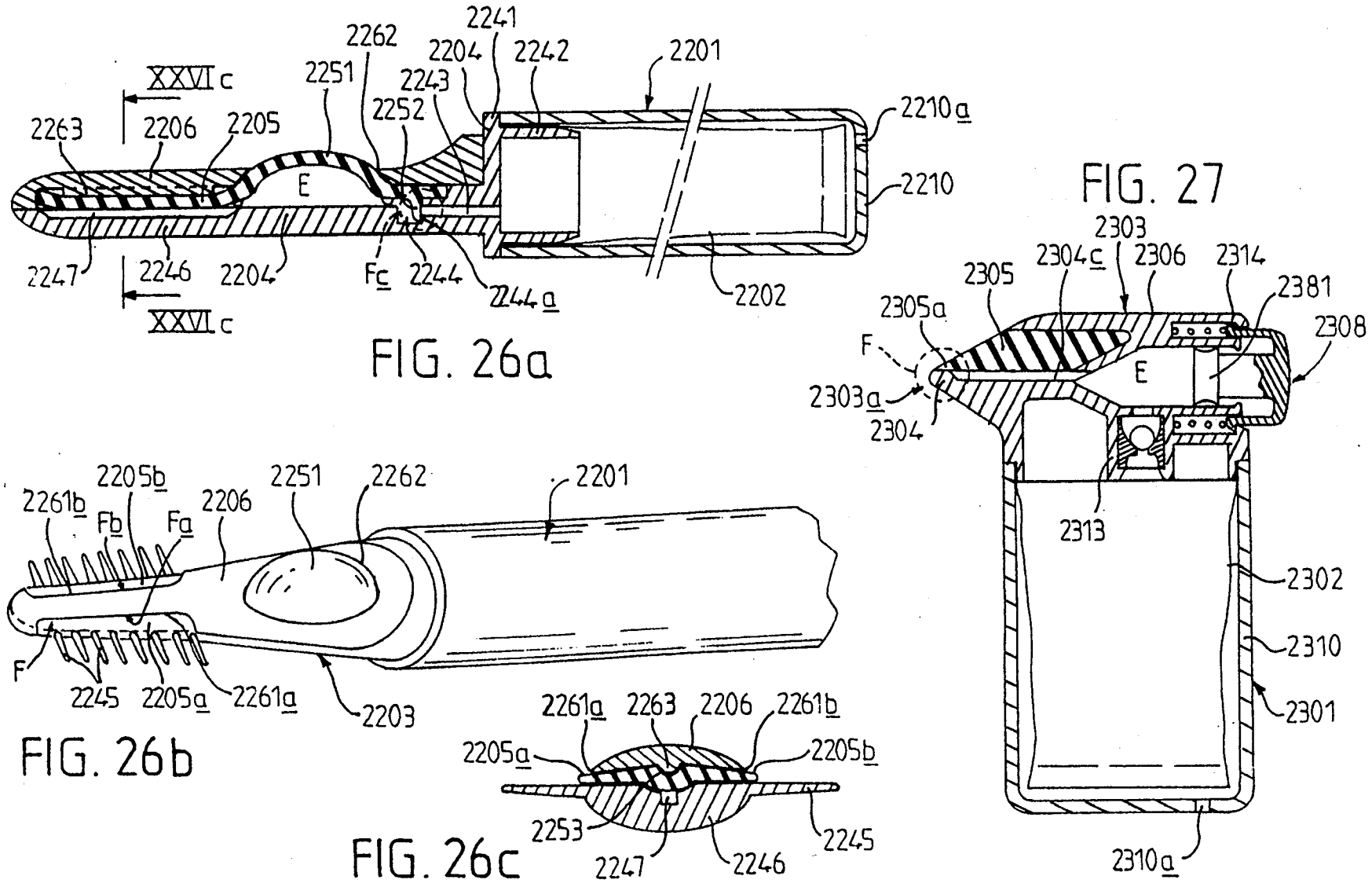
FIGS. 26*a* to 26*c* represent a comb in perspective, in an axial section and a longitudinal section comprising a closing device in accordance with the invention for applying a hair product.
FIG. 27 represents an axial section of a unit in accordance with the invention with a horizontal pump barrel.

FIGS. 26*a* to 26*c* represent a unit 2201 in accordance with the invention serving as a comb for the application of a hair product. The handle of the comb is formed by a rigid shell 2210 provided with an air intake opening 2210*a* and containing a flexible bag 2202. On the comb handle the rigid shell 2210 and the flexible bag 2202), is mounted a dispensing head 2203 having a conical shape with an oval cross-section and provided with teeth 2245. In the remainder of the description, the unit 21 will be considered as being disposed horizontally, as represented in FIGS. 26*a* and 26*b*. The dispensing head 2203 consists of a part 2204 comprising the seat, carrying on each side a row of horizontal teeth 2245. A resilient strip 2205 resting on the support 2204 is protected by a shell 2206 which forms the constraining element disposed on the strip 2205 and is welded at its periphery to the edge of the support 2204. The support 2204 contains a vertical disc 2241 which closes the rigid shell 2210. This disc 2241 carries a skirt 2242 fitted in the rigid shell and serves to fix the flexible bag 2202 whose edge is gripped between the skirt 2242 and the inner side of the rigid shell 2210. On the side remote from the skirt 2242, the disc 2241 carries an eccentric duct 2243 which is cut at its top on the side nearer the handle 2206 to allow the strip 2205 to be fixed between the part 2204 and the shell 2206. The duct 2243 is hollowed out at its bottom below the strip 2205 by a parallelepiped hole having, at its side nearer the handle, a vertical partition 2244*a*. The duct 2243 is extended at its lower portion in a shell 2246 which is provided along its axis of symmetry with a delivery channel 2247 for the product, as may be seen in FIG. 26*c*. In the region of the teeth 2245 of the part 2204, the lateral edges of the strip 2205 form respective bevels 2205*a* and 2205*b* which rest on the symmetrical edges of the shell 2246 forming the seat. Therefore, the edges of the shell 2246 and the lips of the bevels 2205*a* and 2205*b* of the strip 2205 respectively form the lips and the seats of the closing system Fa and Fb in accordance with the invention. In the region of the teeth 2245 of the comb, this strip carries a groove 2253 disposed on the longitudinal axis of symmetry of the strip. Just after the mounting zone between the cover and the cut out of the duct 2243, the strip forms a dome 2251, a space E being arranged between this dome 2251 and the shell 2246. Moreover, at the level of the duct 2243, the strip 2205 carries a stud 2252 turned towards the part 2204 which rests on the partition 2244*a* situated on the handle side of the cavity 2244 of the part 2204. The partition 2244*a* forms the seat for the lip closed by the stud 2252 and the combination of the partition and the lip constitutes a valve Fc. The cover 2206 is fixed by welding or catch engagement on the edge of the support 2204, except in the region of the closing systems Fa and Fb where the cover 2206 comprises two cut outs 2261*a* and 2261*b* for the bevels 2205*a* and 2205*b* of the strip 2205. The cover 2206 is provided with a rib 2263 complementary to the rib 2253 of the strip. The cover 2206 is pierced by a circular opening 2262 through which the dome 2251 projects.

The device functions in the manner described below. When the user wishes to dispense some of the product, he takes the comb by the handle formed by the rigid shell 2210 and he presses on the dome 2251. He thus causes the space E to be reduced and since the valve Fc is closed, he produces excess pressure on the product contained in this space. Under the pressure of the product, the lips 2205*a* and 2205*b* move away from the seat formed by the edge of the shell 2204, and the closing systems Fa and Fb are opened. The product is dispensed on to the teeth of the comb 2245.

When the user stops pressing on the dome 2251 the closing system Fa and Fb close again, the lips 2205*a* and 2205*b* return to the seat formed by the edge of the shell 2204, and the dome 2251 reassumes its natural shape by elasticity which produces low pressure in the space E. The valve Fc opens, the stud 2252 moving away from the partition 2244*a*, and the product contained in the flexible tube 2202 is drawn up into the space E through the duct 2243. Simultaneously, the user can distribute the dispensed product on the head of hair by means of the comb.

FIG. 27 shows a unit 2301 in accordance with the invention, with its dispensing head 2303 comprising a lateral beak 2303*a* and forming a pump. The push button 2308 actuates the piston and is accessible from the side. A flexible bag 2302 is welded on to the dispensing head 2303 and is protected by a rigid shell 2310 provided with an air intake opening 2310*a*. In the dispensing head 2303, the seat-defining part 2304 and the cover 2306 together define an internal space E forming a piston body which is disposed perpendicular to the longitudinal axis of the shell 2310. A lateral push button 2308 mounted on a spring 2314 carries a piston 2381 capable of sliding horizontally in the piston body as represented in FIG. 27. The space E is connected to the flexible bag 2302 by a ball valve 2313 and connected to the outside by a channel 2304*c* to a closing system F whose seat is formed by the surface 2304*d* of the part 2304 on which the lip 2305*a* of a resilient strip 2305 rests.

Figure 28:
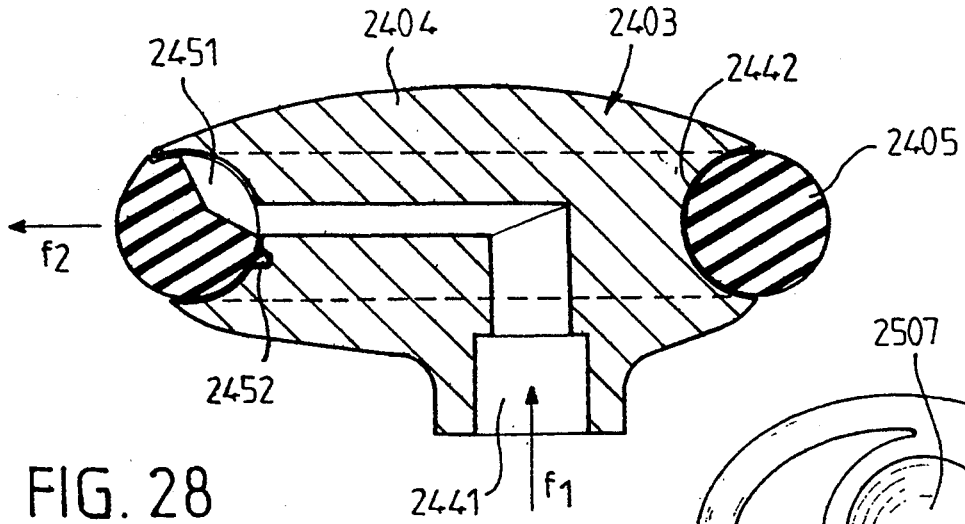
FIG. 28 is a schematic view, in axial section, of a dispensing head where the obturator is constituted by a torus.
Figure 29B:
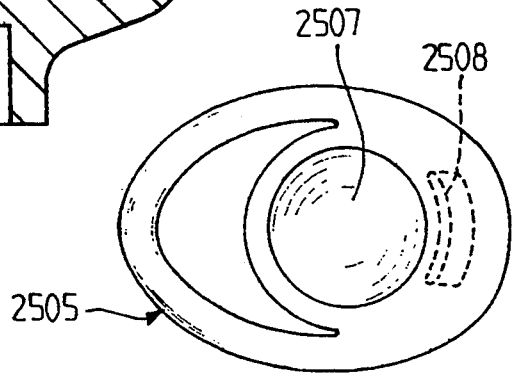
FIG. 29*b* is a top view of the resilient torus.

FIGS. 28 and 29 represent dispensing heads according to the second embodiment of the invention wherein the obturator is a resilient part disposed opposite the outlet of the dispensing duct and which moves away from the seat in a direction parallel to the pressure of the liquid to be dispensed.

FIG. 28 represents a dispensing head 2403 with a lateral outlet. The dispensing head 2403 is formed by a part 2404 comprising the seat 2442 and made of a plastic material, pierced by a dispensing duct 2441 bent at right angles which opens in an annular groove 2442 whose cross-section has the shape of a segment of a circle. A toric part 2405 made of a flexible material is fitted in the groove, which part surrounds the dispensing head 2403. At the outlet level of the dispensing duct, in the groove 2442, the toric part 2405 forms the obturator and the groove 2442 forms the seat. Opposite the outlet of the dispensing duct 2441, the toric part 2405 is provided with a delivery duct 2451 which communicates with the dispensing duct and has a shape such that it can direct the flow of the dispensed product upwards (in FIG. 28). Below the outlet of the dispensing duct (in FIG. 28), the torus 2405 is provided with a stud 2452 fitted in a corresponding groove of the part 2404 and which constitutes the constraining element. In FIG. 28, the dispensing head 2403 is represented in the rest position, the toric part being fitted in the groove 2442 so that the delivery duct 2451 is closed. When some of the product to be dispensed penetrates along arrow f1 into the dispensing duct 2441 and then into the delivery duct 2451, it presses at this level on the torus 2405 which becomes deformed by elasticity and the portion situated opposite the outlet of the duct 2441 is displaced along arrow f2 until this displacement is sufficient for the delivery duct 2451 to communicate with the outside.

Figure 29A:
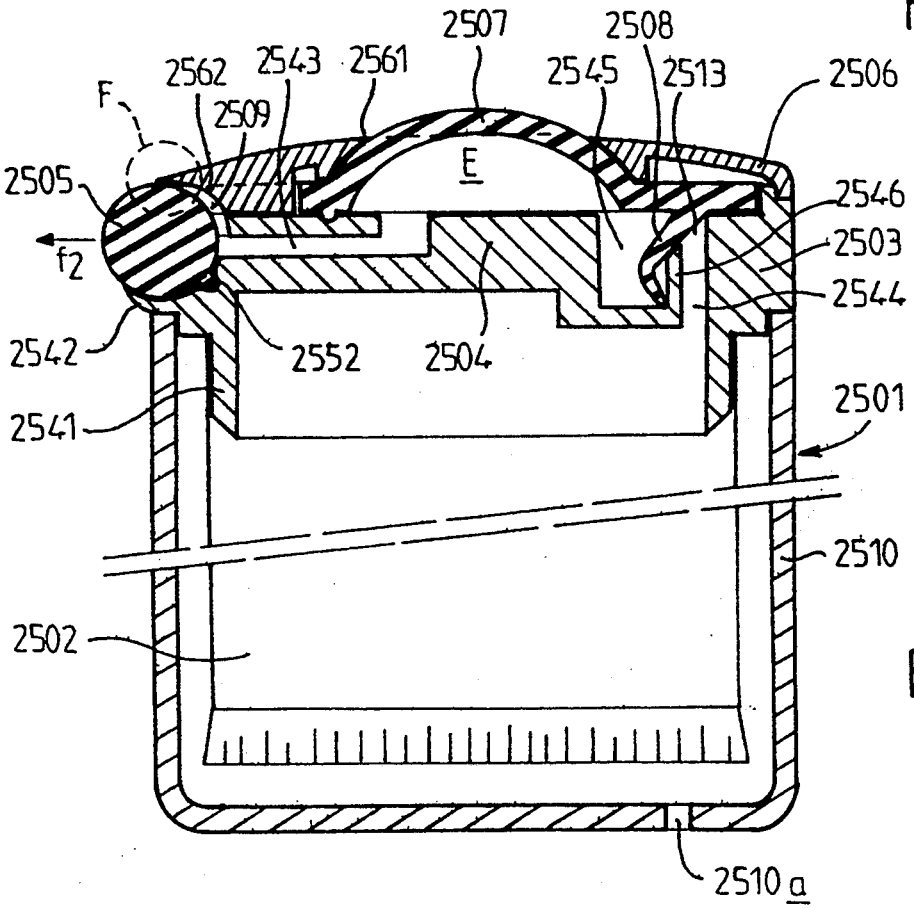
FIG. 29*a* is an axial sectional view of a unit with two valves forming a pump where the obturator forms part of an resilient torus.

FIG. 29*a* and *b* schematically represent a dispensing unit 2501 whose dispensing head 2503 forms a pump because it includes two valves. The dispensing unit 2501 comprises a flexible bag 2502 protected by a rigid shell 2510 provided with an air intake opening 2510*a*. The dispensing head comprises firstly, a part 2504 comprising the seat, secondly a toric part 2505 integrally moulded with a flexible strip forming a dome 2507 and carrying a stud 2508 forming a part of a second valve 2513 and, thirdly a cover 2506. The part 2504 comprising the seat has the general shape of a disc fixed to the upper edge of the rigid shell 2510 and it is provided with an inner cylindrical skirt 2541 to which the flexible bag 2502 is welded. Over a portion of its periphery, it is provided with a groove 2542 having the cross-sectional shape of a circular segment into which there issues a radial duct 2543 in the part 2504. At a point diametrically opposite the outlet of the duct 2543, the part 2504 has a duct 2544 parallel to the longitudinal axis of the unit 2501 which issues in the flexible bag 2502 at one end and communicates with a cut out 2545 of the part 2504 separated from the duct 2544 by a partition 2546 parallel to the axis of the unit 2501 whose upper edge is bevelled.

In cross-section, the toric seal 2505 is circular, provided with a stud 2552 in the region of the closing system, and it is fitted into the groove 2542. The dome 2507 is situated above the support 2504 and it defines, above the support 2504, an internal space E which communicates on the one hand with the duct 2543 and on the other hand, with the cut out 2545. The base of the dome 2507 is extended, on the side remote from the opening of the duct 2543, in a plate carrying a stud 2508 that cooperates with the partition 2546 to form a valve 2513. In this valve 2513, the stud 2508 rests in a leakproof manner on the surface of the edge of the partition 2546. The cover 2506 is fixed to the periphery of the support 2504 and it is provided with an opening 2561 through which the dome 2507 projects. At the level of the torus 2505, the cover 2506 is cut by a groove 2562 having the cross-sectional shape of a circular segment, which is fitted to the groove 2542 to form together therewith (in cross section) a larger circular segment. At the level of the outlet of the dispensing duct 2543, and above it, the groove 2562 and a fraction of the groove 2542 are provided with a delivery duct 2509 for the product.

The unit 2501 functions as follows. When the user wishes to dispense the product, he presses on the resilient dome 2507 and reduces the internal space E since the valve 2513 is closed. The product contained in the space E is subjected to excess pressure and exerts pressure via the duct 2543 on the torus 2505 to displace it by elasticity in the direction of arrow f2, thereby opening the delivery duct 2509 towards the outside. The product is dispensed. When the user stops pressing on the elastic dome 2511 the pressure of the product to be dispensed, on the torus 2505, stops and the torus reassumes its position by elasticity and closes the duct 2509. Since the dome reassumes its shape by elasticity, low pressure is generated in the space E. This low pressure causes the valve 2513 to open, the stud 2508 moving away by being bent from the edge of the partition 2546. Some of the product contained in the bag 2502 is drawn up into the space E via the duct 2544 and the cut out 2545. The dispensing head is ready for a fresh dispensing of the product.

I/we claim:

1. In a unit for dispensing at least one fluid product, said unit comprising:

(a) a container;

(b) a dispensing head;

(c) said dispensing head including means defining at least one dispensing duct for said at least one fluid product to be dispensed, said dispensing duct having a first and a second end;

(d) closing means situated at said second end of the said at least one dispensing duct;

(e) said dispensing duct means comprising an obturator which forms part of a first component of the dispensing head made of an elastically deformable material and at least one seat which forms part of a second component of the dispensing head;

(f) said obturator being adapted to be in contact with said seat when no dispensing is taking place, but to move away from said seat by elastic deformation under pressure of the product being dispensed and to reenter into contact with said seat by elasticity when dispensing stops;

the improvement comprising:

(g) said at least one dispensing duct comprising a first duct portion having one end in communication with a flexible enclosure for the product and a second end in communication with a one way valve means; said dispensing head including operating means for opening said one way valve means to cause the product to move through said one way valve means toward said obturator, said one way valve including a first member having a plurality of apertures surrounded by a shoulder and a second member including a peripheral portion overlying said shoulder with said peripheral portion including a plurality of apertures movable into and out of engagement with said shoulder to define a flow path through said one way valve means.

2. The invention as claimed in claim 1, wherein said first duct portion extends parallel to the longitudinal axis of the dispensing unit, said first duct portion communicating with the flexible enclosure, said flexible enclosure being located in said container, said dispensing duct comprising a second duct portion extending at an angle relative to said first duct portion to define a lateral outlet, said second duct portion terminating in said second end of said dispensing duct and which is remote from said first duct portion, said obturator comprising a strip having an end terminating in an elastic lip wherein said elastic lip has a portion extending transverse to said second duct portion as to be movable away from said second duct portion in a direction parallel to the dispensing direction of the product.

3. The dispensing unit as claimed in claim 1, wherein said obturator is formed of one of the group comprising: a natural, a synthetic and a thermoplastic elastomer, said elastomer being associated with said rigid seat to define a second duct portion.

4. The dispensing unit as claimed in claim 1, wherein said constraining element is made of a resilient material.

5. The dispensing unit as claimed in claim 1, wherein said at least said first end of said dispensing duct is defined by a part made of a flexible material comprising the obturator and a part comprising the seat for the obturator.

6. The dispensing unit as claimed in claim 1, wherein a second duct portion has a second end and said second end of said second duct portion includes a sloping portion sloping at an angle to the longitudinal axis of said second duct portion.

7. In a unit for dispensing at least one fluid product, said unit comprising:

(a) a container;

(b) a dispensing head;

(c) said dispensing head including means defining at least one dispensing duct for said at least one fluid product to be dispensed, said dispensing duct having a first and a second end;

(d) closing means situated at said second end of the said at least one dispensing duct;

(e) said dispensing duct means comprising an obturator which forms part of a first component of the dispensing head made of an elastically deformable material and at least one seat which forms part of a second component of the dispensing head;

(f) said obturator being adapted to be in contact with said seat when no dispensing is taking place, but to move away from said seat by elastic deformation under pressure of the product being dispensed and to reenter into contact with said seat by elasticity when dispensing stops;

the improvement comprising:

(g) said at least one dispensing duct comprising a first duct portion having one end in communication with a flexible enclosure for the product and a second end in communication with a one way valve means; said dispensing head including operating means for opening said one way valve means to cause the product to move through said one way valve means toward said obturator, said dispensing head including a constraining element engaging said obturator to restrain movement of said obturator during dispensing to thereby cause the product to be dispensed by movement along said dispensing duct to said second end thereof to be dispensed, said constraining element comprising a cover extending over at least a part of said obturator.

* * * * *